US007040776B2

(12) United States Patent
Harrell et al.

(10) Patent No.: US 7,040,776 B2
(45) Date of Patent: May 9, 2006

(54) SELF-CONTAINED ILLUMINATION DEVICE FOR MEDICINE CONTAINERS

(75) Inventors: William T Harrell, Germantown, TN (US); Roy E Williams, Colierville, TN (US); Brian M Callies, Cordova, TN (US)

(73) Assignee: William T. Harrell, Germantown, TN (US)

( * ) Notice: Subject to any disclaimer, the term of this patent is extended or adjusted under 35 U.S.C. 154(b) by 0 days.

(21) Appl. No.: 10/649,904

(22) Filed: Aug. 26, 2003

(65) Prior Publication Data

US 2005/0047114 A1 Mar. 3, 2005

(51) Int. Cl.
*F21V 33/00* (2006.01)

(52) U.S. Cl. ..... 362/154; 362/101; 362/155

(58) Field of Classification Search ..... 362/96, 362/101, 154, 155, 562, 125, 186, 200–208, 362/212, 800, 802, 812
See application file for complete search history.

(56) References Cited

U.S. PATENT DOCUMENTS 4,072,855 A * 2/1978 Marchese ..... 362/101
4,736,138 A * 4/1988 Masaki ..... 315/310
4,836,476 A * 6/1989 Wolf ..... 248/146
5,178,450 A * 1/1993 Zelensky et al. ..... 362/154
5,504,663 A * 4/1996 Tucker ..... 362/101
5,575,553 A * 11/1996 Tipton ..... 362/101
5,743,620 A * 4/1998 Rojas et al. ..... 362/101
5,785,407 A * 7/1998 Ratcliffe et al. ..... 362/101
6,065,848 A * 5/2000 Tucker et al. ..... 362/101
6,086,216 A * 7/2000 Goldfarb ..... 362/101
6,254,247 B1 * 7/2001 Carson ..... 362/101
6,511,196 B1 * 1/2003 Hoy ..... 362/101
6,793,362 B1 * 9/2004 Tai ..... 362/101
2003/0115781 A1 * 6/2003 Boutilier ..... 40/310

FOREIGN PATENT DOCUMENTS

WO WO 200190640 A1 * 11/2001

* cited by examiner

*Primary Examiner*—Ali Alavi
*Assistant Examiner*—Hargobind S. Sawhney
(74) *Attorney, Agent, or Firm*—Roy E. Williams

(57) ABSTRACT

A self-contained illumination device for illuminating medicine container labels in low-light level conditions is provided. The illumination means includes a light source component for illumination, an electrical switch component to control the light source, supporting circuitry components to energize the light source, and a housing structure for supporting and enclosing the components, directing the illumination to the label, and coupling the illumination device to a medicine container receptacle or a conventional medicine container cap.

31 Claims, 23 Drawing Sheets

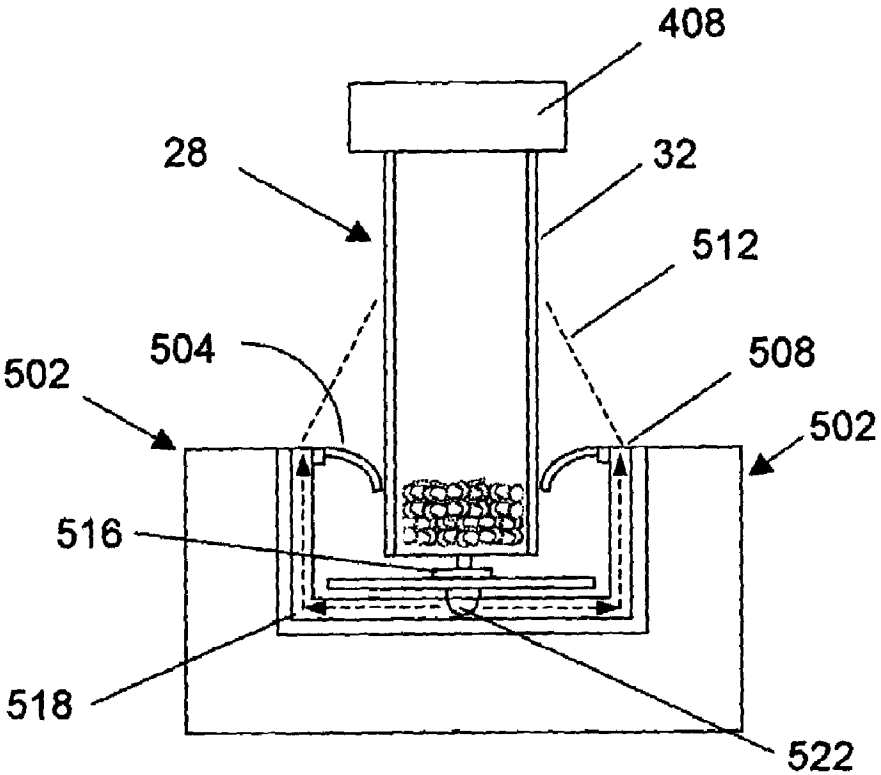
FIG. 24B
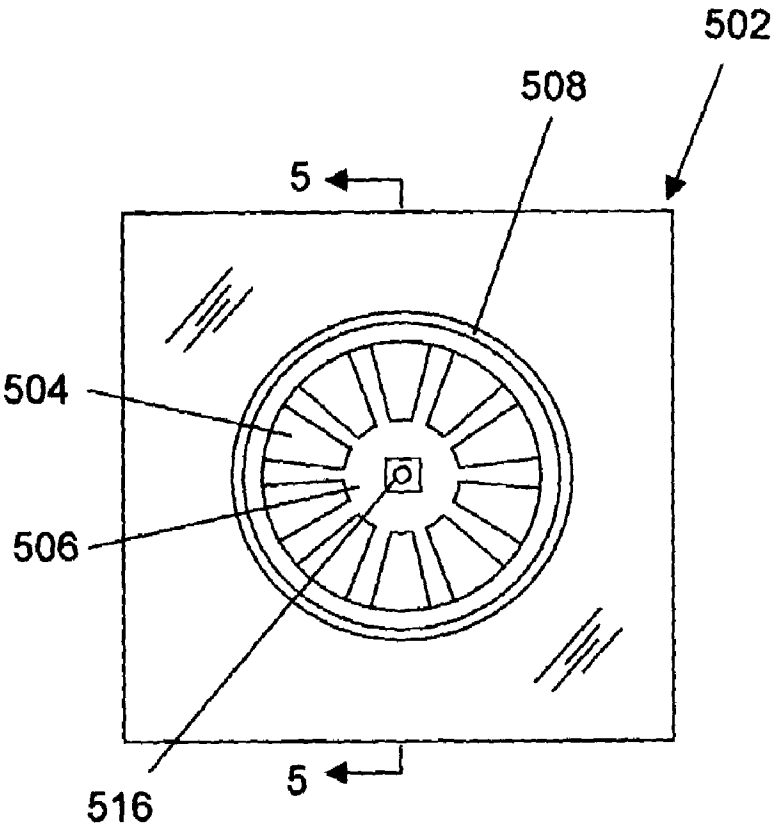
FIG. 24A
FIG. 24

SELF-CONTAINED ILLUMINATION DEVICE FOR MEDICINE CONTAINERS

CROSS REFERENCES TO RELATED APPLICATIONS

Not applicable.

BACKGROUND

1. Field of Invention

The present invention relates to a self-contained illumination device for containers and more particularly pertains to permitting illumination of difficult-to-read medication labels in low-light environments with an illumination device for medicine containers.

2. State of the Art

There are many occasions when an individual must wake from sleep, arise and take medications during the nighttime hours, when light levels are low. Medications, such as pain medicine, sleeping pills, antacids, migraine medicine, and medication that must be taken on timed schedules (e.g., four times per 24-hour period), among others, are often taken in the nighttime hours. Often, the individual requiring the medication has been asleep and thus is groggy and sometimes disoriented. The medication is generally contained in a medicine cabinet and/or a drawer in the bathroom, or in a drawer near the individual's bed, along with many other medications (which are increasing every year as many new drugs become available, and as the population of the elderly increases). When combined, the above conditions, e.g., low light and/or no light, multiple medications in one location, pain and sleepiness, can increase the chances that the individual will take the wrong medicine or dosage.

One method for decreasing the chance of taking the wrong medicine is to provide light so that the individual can accurately read the medicine container label. The most often used method for achieving this is by turning on a light-within the room (e.g., an overhead light in the bathroom or a desk lamp near the bed). This method has the disadvantage of causing further pain and disorientation, as the individual's pupils are most likely dilated due to the low-light level conditions and the sleep state. This method also has the undesirable affect of disrupting the sleep pattern of the individual, by bringing him closer to the state of awakeness, thus possibly further complicating the condition requiring the medication. Another less-used-method for providing light is to use some type of hand-held light, such as a flashlight or book-reading light, to illuminate the medicine container. Due to the direct, bright light of these devices, this method has similar problems as turning on a light, as discussed above. Additionally, this method is more difficult for the sleepy, groggy individual, as it requires two hands to examine the medicine container label and to open the container and retrieve the medicine. Further, flashlights and book-reading lights are often misplaced, have run-down batteries, and may not be in the correct location when needed. Finally, a nightlight may be used, but often these are not even available, or are situated away from the medicine container location (e.g., usually in an electrical outlet near the floor and/or near the toilet) and thus the patient must carry many medicine containers to the nightlight in order to retrieve the correct medicine. Again, this method is more difficult for the sleepy, groggy individual and offers the further danger of the individual falling and/or colliding with something in the pathway to the nightlight.

While these methods fulfill the objective of aiding the individual in retrieving the correct medication, it is obvious that they can exacerbate the original problem that caused the need for medication, or even cause further problems.

Therefore, from the above, it can be appreciated that there is a pressing and increasing need for a means to provide better illumination of medicine containers.

SUMMARY OF THE INVENTION

The present invention is directed to improved containers for medicines, and in particular to improved illumination of medicine container labels to aid the individual in retrieving the correct medication in low-light level environments.

OBJECTS AND ADVANTAGES

It is therefore an object of the invention to provide an illumination device for medicine containers, which prevents the possibility of an individual taking the wrong medication due to low-level lighting conditions.

It is another object of the invention to provide an illumination device for medicine containers, which illuminates the medicine container label in such a way, that the individual's eyes receive a minimum amount of direct light.

It is a further object of the invention to provide an illumination device for medicine containers, which illuminates the medicine container label with a wavelength (color) and level of light intensity that does not cause the individual discomfort due to dilated pupils.

It is also an object of the invention to provide an illumination device for medicine containers, which may be easily and efficiently manufactured and marketed.

It is an additional object of the invention to provide an illumination device for medicine containers, which is of durable and reliable construction.

It is yet another object of the invention to provide an illumination device for medicine-containers, which is waterproof.

It is yet a further object of the invention to provide an illumination device for medicine containers, which couples to a wide variety of types of medicine containers and/or medicine container caps used in the medical area.

It is yet an additional object of the invention to provide an illumination device for medicine containers, which is adapted to a low cost of manufacture with regard to both materials and labor, thereby making the invention disposable or reusable, and which accordingly is then adapted for sale at low prices to the consuming public, thereby making such an illumination device for medicine containers economically available to the buying public.

In accord with these objects, which will be discussed in detail below, a self-contained illumination device for medicine containers is provided. The illumination device includes a light source component for illumination, a switch component to control the light source, supporting circuitry components to energize the light source, and a housing structure for: supporting and enclosing the components; directing the illumination to the label; and coupling the illumination device to a medicine container and/or a conventional medicine container cap. In a preferred embodiment, a light emitting diode (LED), emitting a bluish color, provides the illumination. An electrical switch is provided to connect an energy source to the LED thus turning it "ON." The light generated by the energized LED is further directed through a circular light-pipe channel within the device, which then directs it toward the label, thereby illuminating the label in a 360-degree field. Supporting circuitry includes a battery with an electrical current-limiting potentiometer mounted on a printed circuit board (PCB). The housing structure is a molded plastic material containing a flexible material positioned directly over the switch, which allows the individual to activate the switch while also providing protection of internal components from the outside environment, e.g., a waterproof seal. Additionally, the housing structure provides the light-pipe channel; encapsulates the above components; and is designed to couple to a medicine container receptacle and/or a conventional medicine container cap.

The resultant self-contained illumination device for medicine containers is adapted for excellent illumination of medicine container labels in low-light level environments. An illumination device for medicine containers has application in the medical arts in the home environment for both humans and pets, unfamiliar locations (e.g., hotel rooms while traveling, camping, etc.), the clinical environment (hospitals and long-term care facilities), and in the pharmaceutical environment (pharmacies and/or pharmaceutical production laboratories); in the use of chemical handling in low-light level conditions, such as in chemical laboratories and/or photography laboratories; and in the general home environment, for example, with spice containers, jars or household cleaners, in non-lighted cabinets or at night; among other fields.

There has been outlined, rather broadly, features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE DRAWINGS

FIG. 24A is a top plan view of the container illumination base shown in FIG. 23;

FIG. 24B is a cross-sectional profile through the medicine container and container illumination base, taken on line 5—5 in FIG. 24A;

DETAILED DESCRIPTION OF THE PREFERRED EMBODIMENTS

Figure 1:
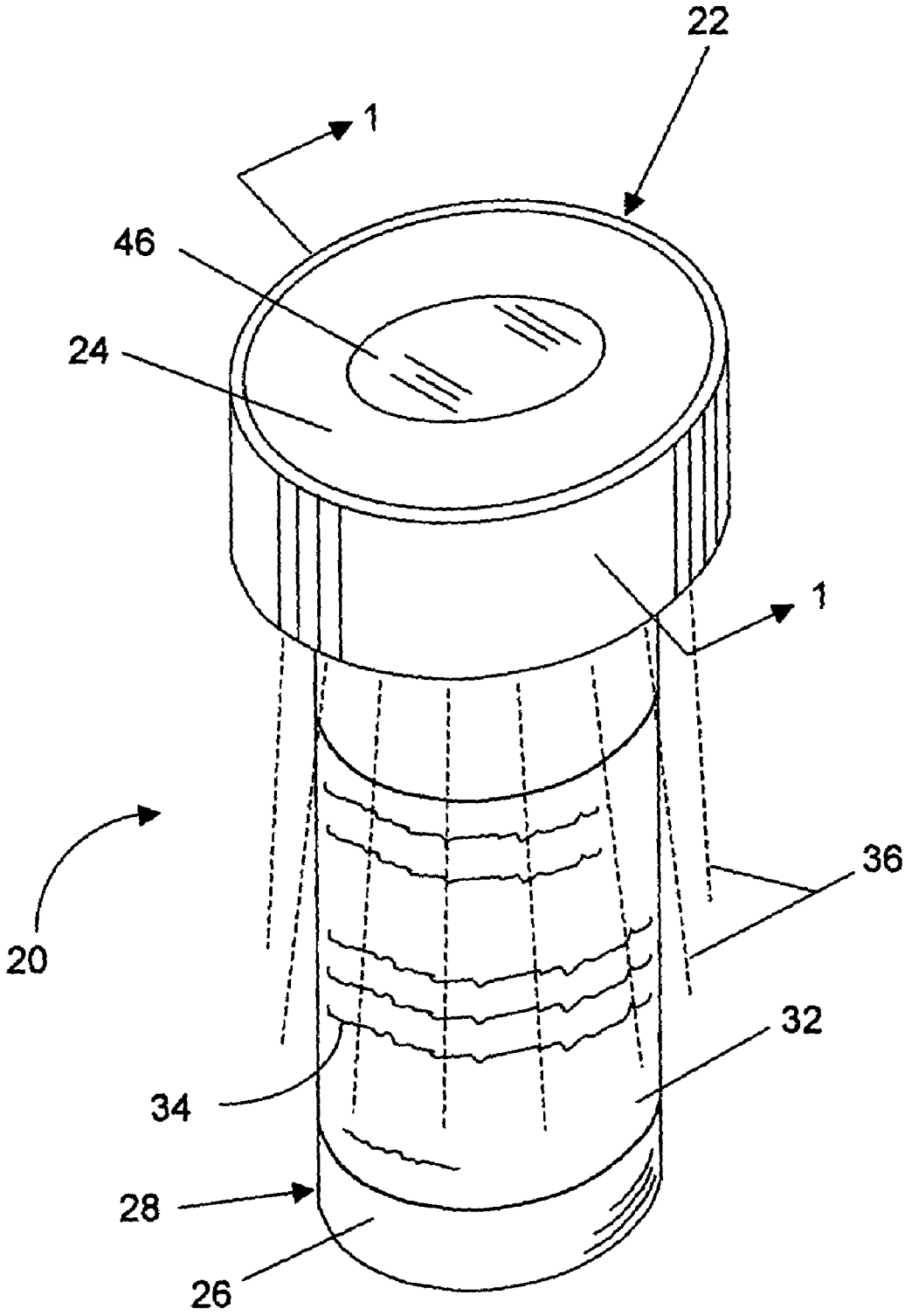
FIG. 1 is a perspective view of the preferred embodiment of a medicine container with a container cap that illuminates a container label with light in a continuous 360-degree range.
Figure 2:
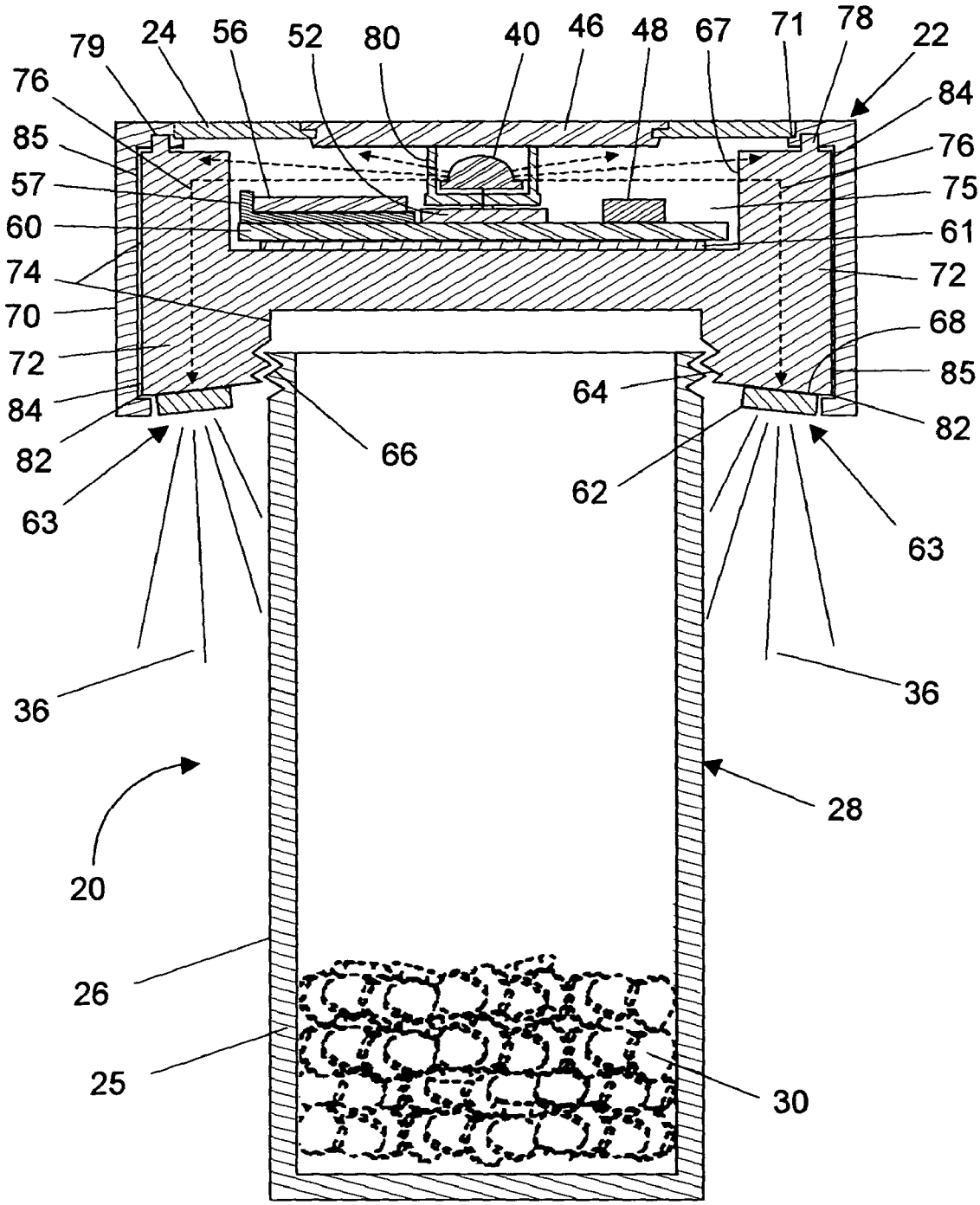
FIG. 2 is a cross-sectional profile through the medicine container and container cap, taken on line 1—1 in FIG. 1, describing a side view of the functional components contained within the container cap.

With reference now to the drawings, FIGS. 1 through 9 illustrate a medicine container, generally 20, embodying a container cap, generally 22, and a container label 32 attached to a container receptacle 28 of the present invention. Container receptacle 28 includes a wall 25 with an outer surface 26. Label 32 attaches to outer surface 26 and includes a set of instructional text 34, or other indicia, which lists information about the patient and a medicinal product 30 contained in the container receptacle 28, including product name, dosage instructions, expiration date, refill information, and/or other medicinal product information. This set of instructional text 34, and identification of the medicinal product 30, is the critical information the patient must read and recognize, respectively, in the low-light level environment. Additionally, label 32 may also be in the form of a small, peel-back instructional booklet, usually with very small print, which contains additional information regarding the medicinal product 30. Other types of container labels 32 may exist as well and be illuminated by a plurality of light beams, generally 36.

Container cap 22 is comprised of an inner annular support structure 74 having a central opening 75 into which is placed a printed circuit board 60. Thus, printed circuit board 60 is contained within container cap 22 and is preferably positioned perpendicular to the longitudinal axis of the attached container receptacle 28. Printed circuit board 60 is secured in central opening 75 to inner annular support structure 74 preferably by an adhesive 61, such as AS-124M removable adhesive, available from Adhesives Research, Inc., although other securing methods may be used (e.g., bonding agents or mechanical fasteners). An outer annular support rim 70 contains an aperture ledge 71, which accepts a container cap insert cover 24. Container cap insert cover 24 is connected to outer annular support rim 70 at aperture ledge 71 by a frictional fit or by an adhesive, e.g., silicone rubber or AS-124M removable adhesive, available from Adhesives Research, Inc. Outer annular support rim 70 fits onto inner annular support structure 74 at an annular snap junction 82 to form a physical connection between the two (or outer annular support rim 70 can be attached to inner annular support structure 74 by an adhesive, such as silicone rubber). A plurality of anti-rotation pins 78 engage a plurality of anti-rotation pin apertures 79, located in outer annular support rim 70, to keep outer annular support rim 70 from rotating as container cap 22 is tightened or removed. Inner annular support structure 74 is preferably fabricated by molding a clear or transparent plastic material, such as Acrylic or Lexan. Outer annular support rim 70 is preferably fabricated by molding an opaque plastic material, such as colored Acrylic or colored Lexan, or a moldable rubber material which provides additional gripping friction, such as GE Silicones liquid injection moldable rubber, LSR2005 elastomer. Additionally, inner annular support structure 74 and outer annular support rim 70 can be machined from plastic stock (e.g., cast Acrylic rod).

Figure 6:
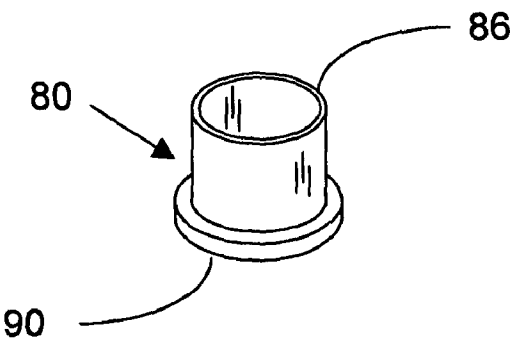
FIG. 6 is a perspective view of a cylindrical adaptor used to connect the flexible membrane to an electrical switch.
Figure 3:
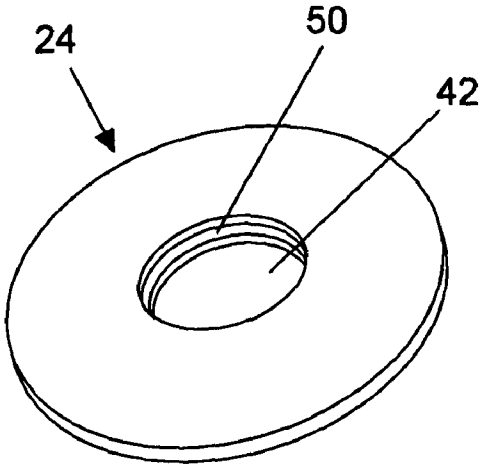
FIG. 3 is a perspective view of a container cap insert cover, which retains a flexible membrane.
Figure 5:
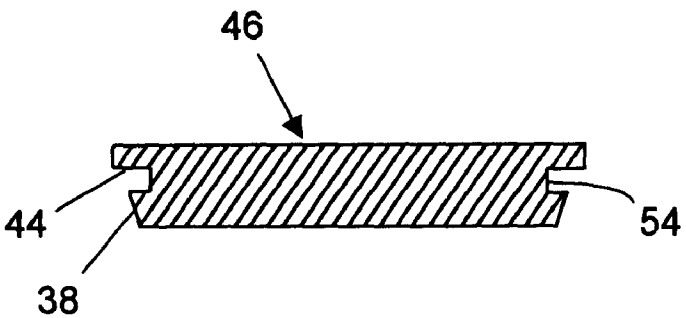
FIG. 5 is a cross-sectional profile of the flexible membrane.
Figure 7:
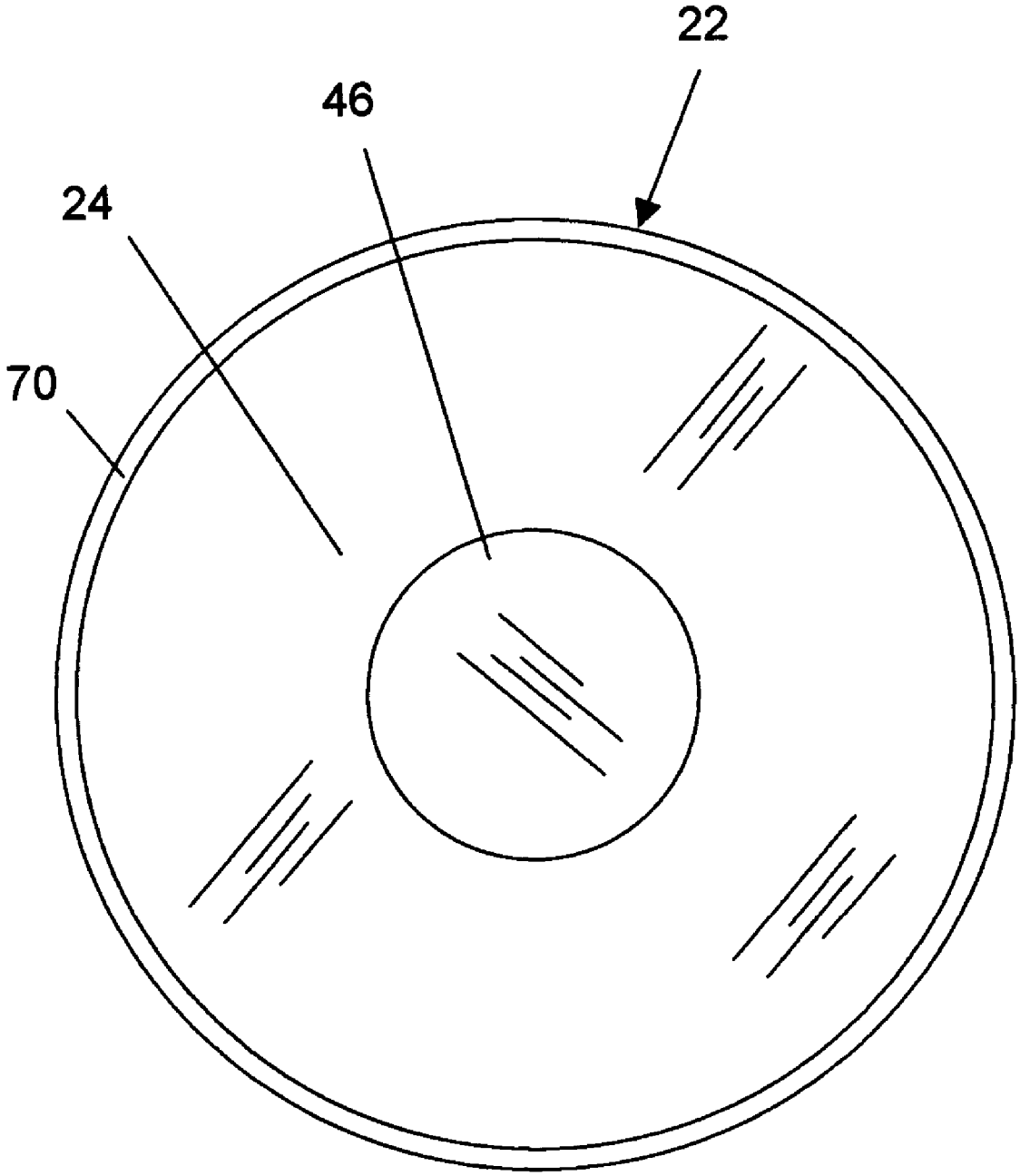
FIG. 7 is a top plan view of the container cap of FIG. 1 showing the flexible membrane material and the container cap insert cover.
Figure 8:
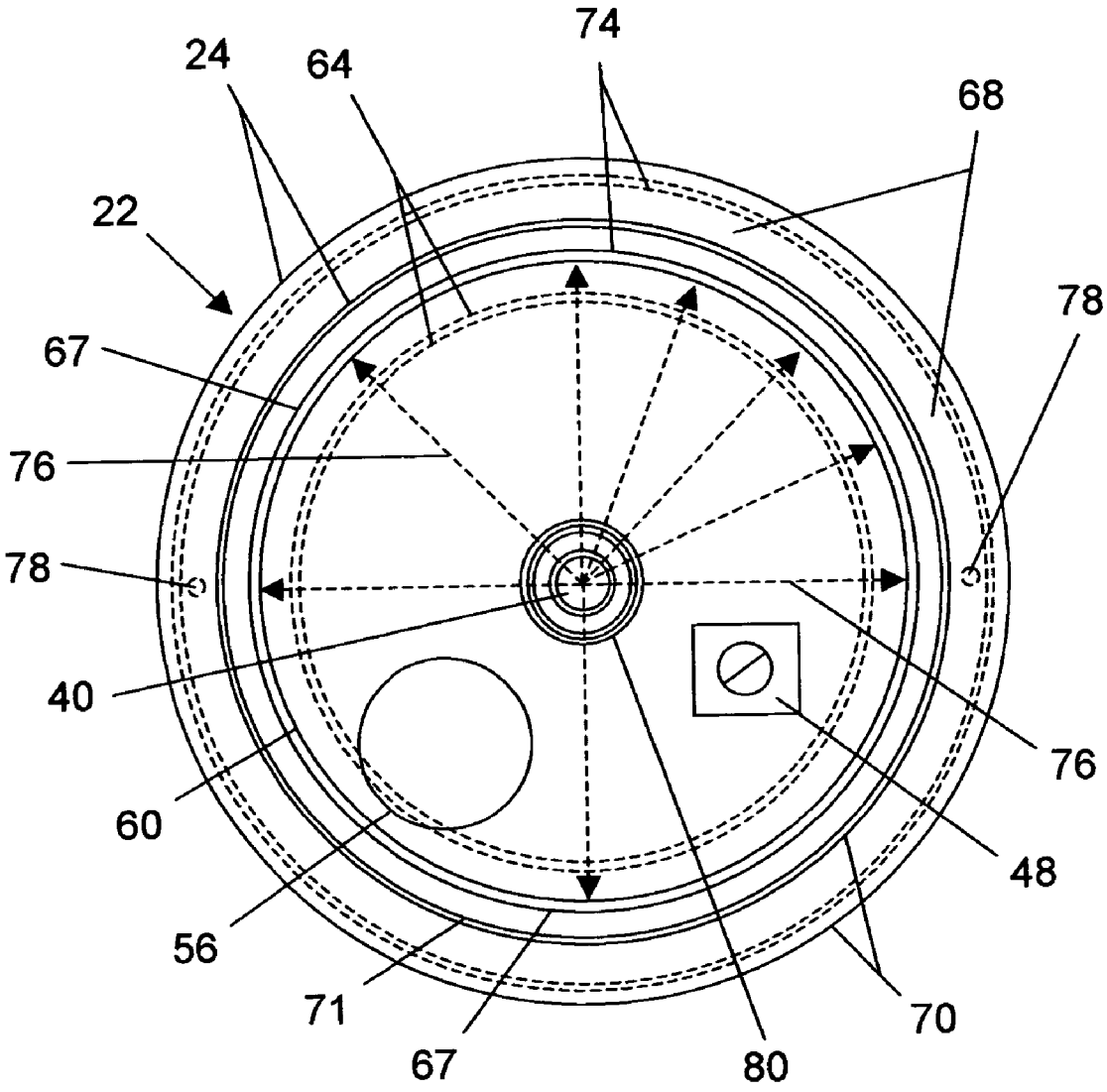
FIG. 8 is a top view of the functional components contained within the container cap of FIG. 2 with the container cap insert cover removed.
Figure 9:
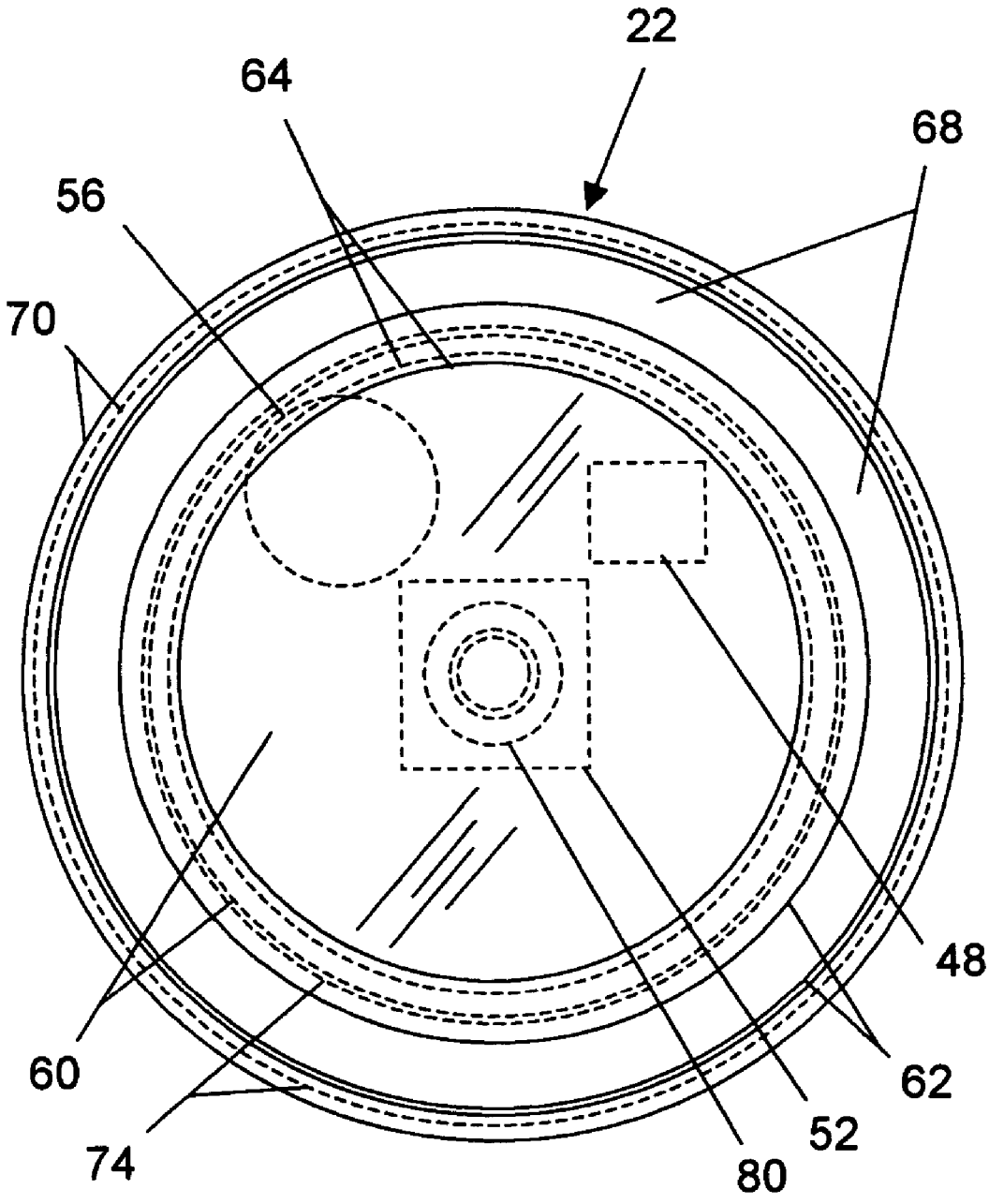
FIG. 9 is a bottom plan view of the container cap of FIG. 1 showing an annular output opening and functional components contained within the container cap.
Figure 10:
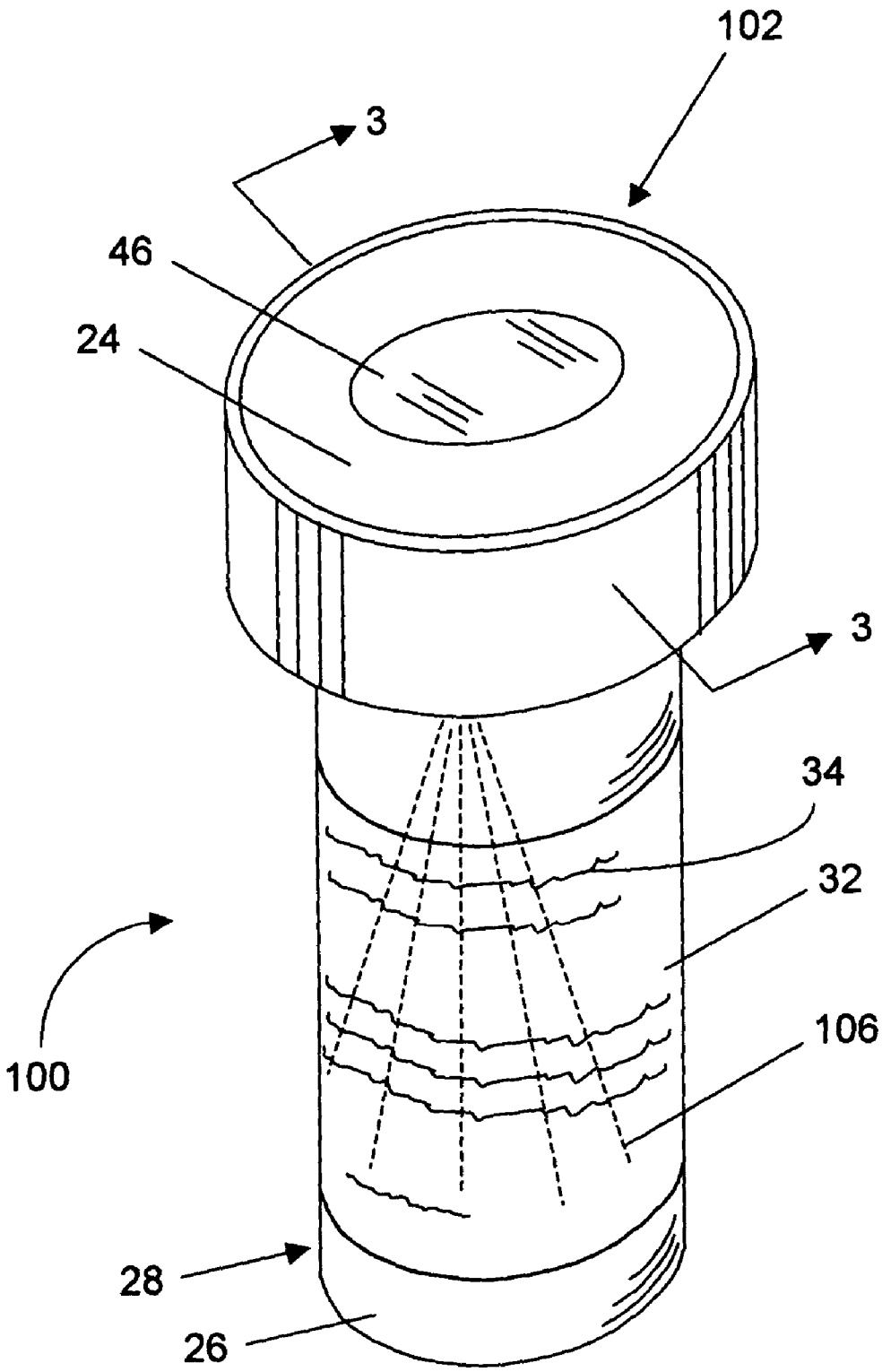
FIG. 10 is a perspective view of a second embodiment of a medicine container with a container cap that illuminates the container label with visible light in a continuous 360-degree range using multiple LEDs.
Figure 11:
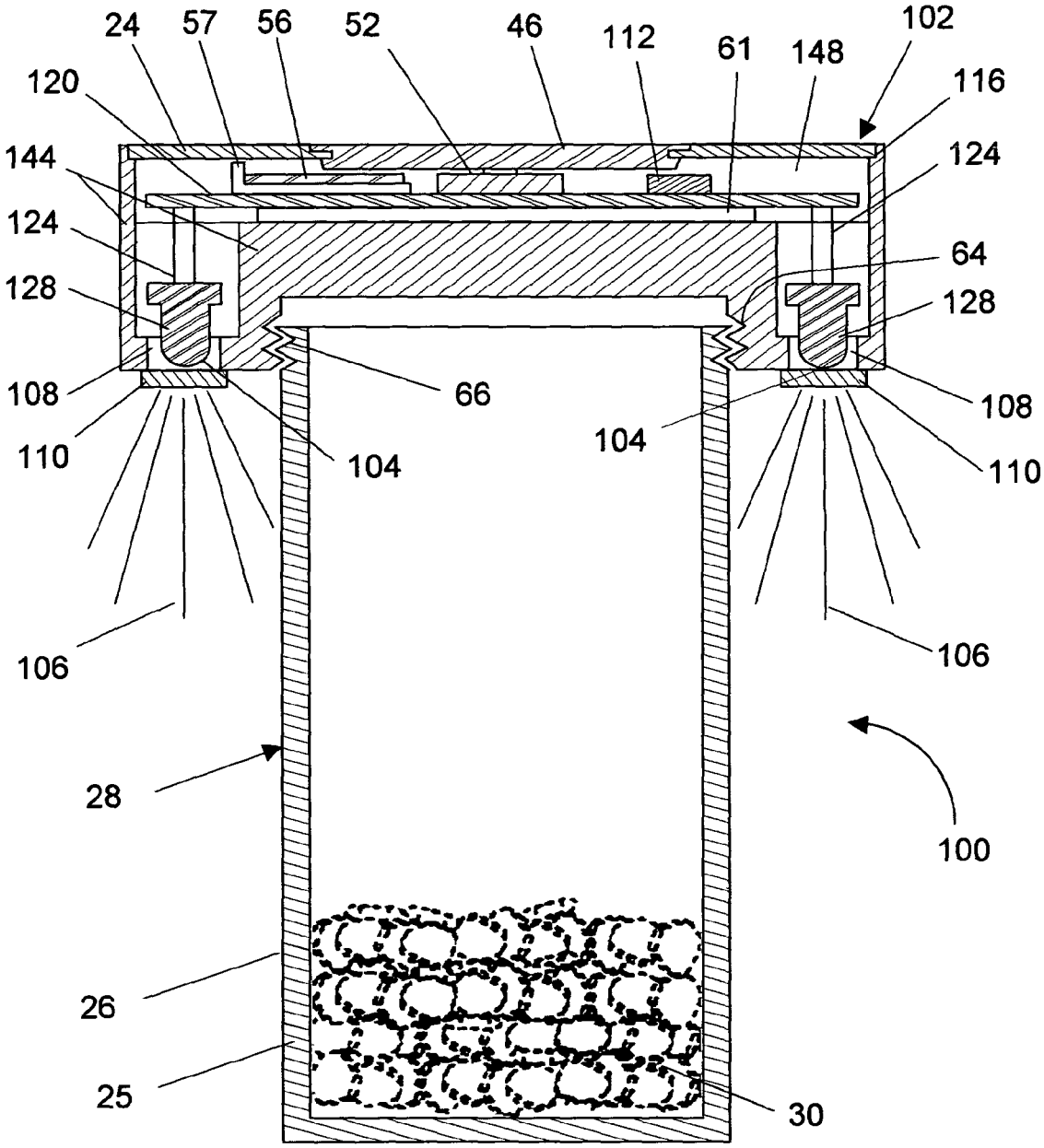
FIG. 11 is a cross-sectional profile through the medicine container and container cap, taken on line 3—3 in FIG. 10, describing a side view of the functional components contained within the container cap.
Figure 12:
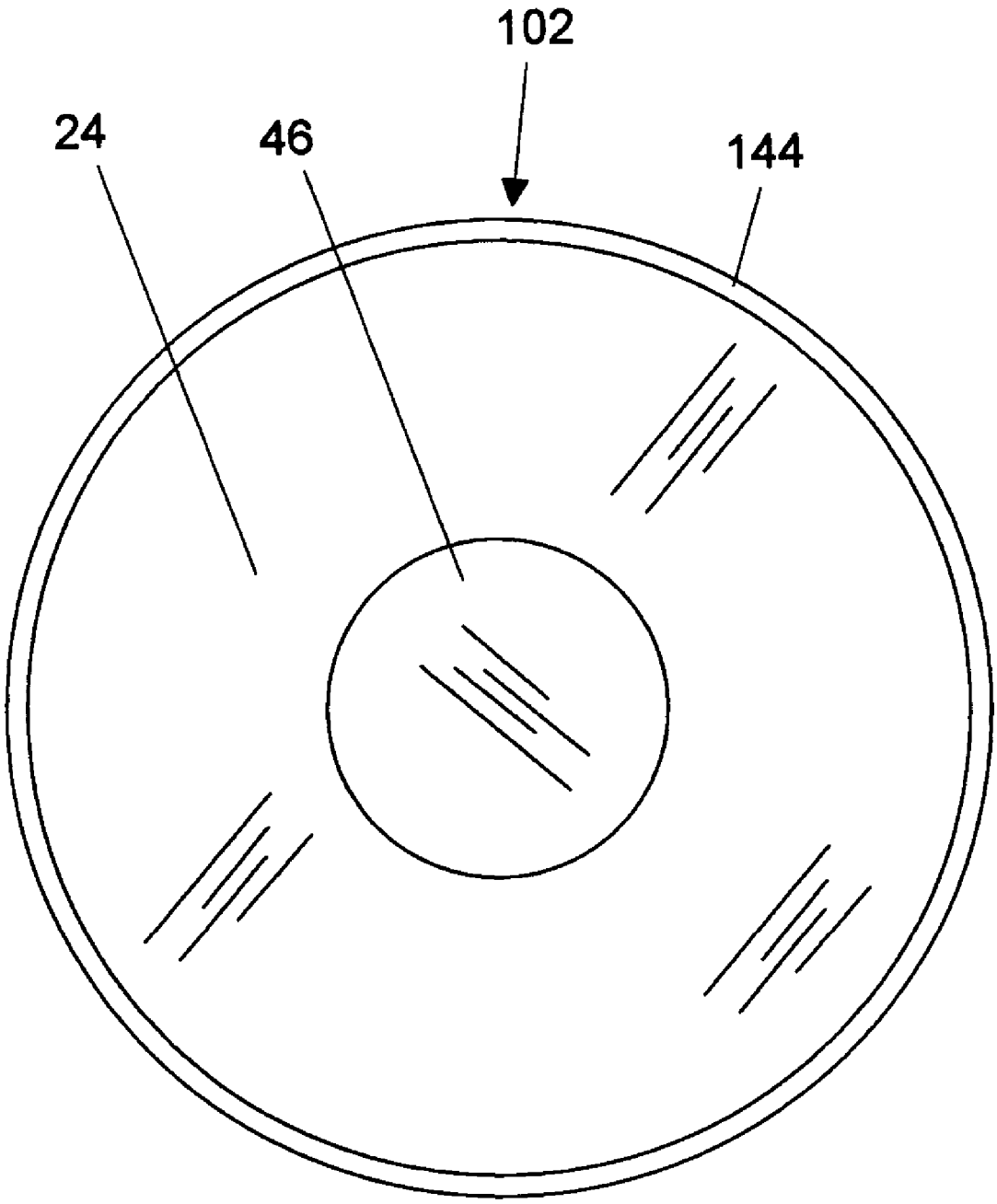
FIG. 12 is a top plan view of the container cap of FIG. 10 showing the flexible membrane material and the container cap insert cover.
Figure 13:
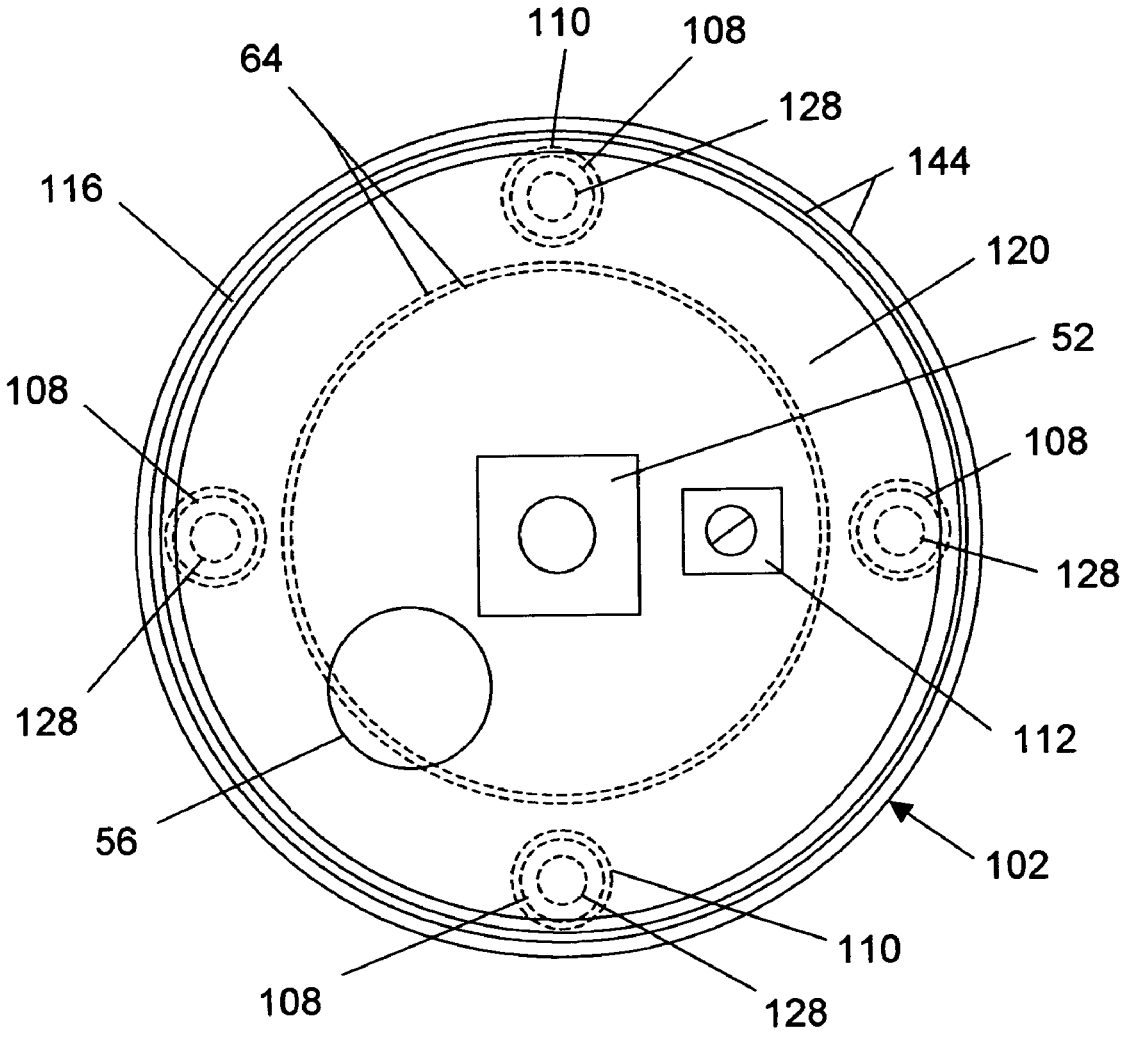
FIG. 13 is a top view of the functional components contained within the container cap of FIG. 10 with the container cap insert cover removed.
Figure 14:
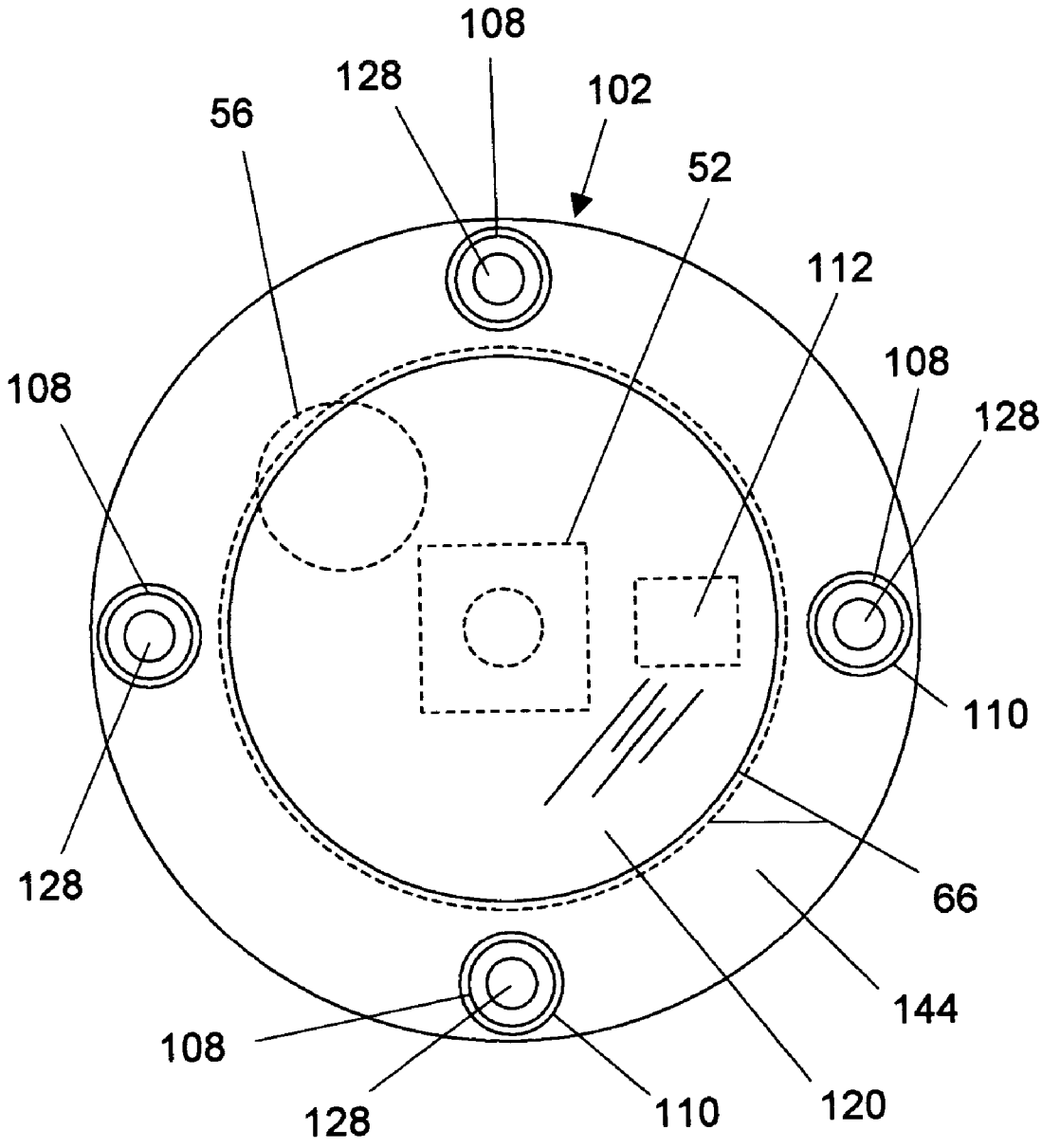
FIG. 14 is a bottom plan view of the container cap of FIG. 10 showing four LEDs used for illumination.

As seen in FIG. 3, container cap insert cover 24 is formed with an insert aperture 42 which accepts a flexible membrane 46, preferably constructed from some type of rubber, e.g., silicone rubber, although any flexible material may be used. As seen in FIG. 5, flexible membrane 46 has a circumferential groove 54 with a tapered neck 38 just below groove 54. When the flexible membrane 46 is inserted into container cap insert cover 24 with the tapered neck 38 projecting downwardly through insert aperture 42, circumferential groove 54 engages insert aperture 42. Additionally, flexible membrane lip, generally 44, seats against an insert ledge 50, which is countersunk in container cap insert cover 24, thus forming a smooth top surface for container cap 22, that is, flexible membrane 46 does not protrude above container cap 22. Flexible membrane 46 forms an environmentally protective barrier, e.g., waterproof, as well as making physical contact with an electrical switch 52, e.g., a single-pole, single throw Panasonic EVQ-PLDA15, through a cylindrical adaptor 80, containing a top surface 86, which contacts flexible membrane 46, and a bottom surface 90, which contacts electrical switch 52 (FIG. 6). Cylindrical adaptor 80 is preferably manufactured from a clear Acrylic plastic, although different colored material may be used to change the final illumination color (discussed in more detail below). Container cap 22 also contains structure to produce a light pipe channel 72, which is annular in shape in the preferred embodiment. The light pipe channel 72 has a lightwave entry end 67 and a lightwave exit end 68. A lightwave 76, generated by an illumination source 40, e.g., a wide-angle, blue light emitting diode, such as a Lumex SSL-LX3044USBD, enters lightwave entry end 67 in a 360-degree direction (see FIGS. 2 and 8). Optionally, other LEDs, emitting other wavelengths (colors), or incandescent bulbs, such as a Copeland retinoscope lamp bulb, may be used to generate lightwave 76. Once inside light pipe channel 72, lightwave 76 travels to lightwave exit end 68 and is emitted in a 360-degree direction.

Additionally, the outer surface, generally 84, of the inner annular support structure 74 may be coated with a reflective coating, such as gold, silver or aluminum, or with multilayer dielectric mirror coatings, to increase the internal reflection of lightwave 76 toward lightwave exit end 68. Alternatively, the inner surface, generally 85, of the outer annular support rim 70 may be coated with a reflective coating, such as gold, silver or aluminum, or with multilayer dielectric minor coatings, to increase the internal reflection of lightwave 76 toward lightwave exit end 68. Lightwave exit end 68 is formed at a slight angle, e.g., 80-degrees from the longitudinal axis of attached container receptacle 28, thus directing the light beams 36 more directly onto label 32, a technique commonly known in the art as "front lighting." Alternatively, lightwave exit end 68 can be formed with no angle, e.g., 90-degrees to the longitudinal axis of attached container receptacle 28, while still providing adequate front light illumination of label 32.

Lightwave 76 emerges from lightwave exit end 68 through an annular filter cover 62 to produce plurality of light beams 36, generally at annular output opening 63. Annular filter cover 62 may be clear, or may be manufactured with different colors depending on the color of the LED used. For example, annular filter cover 62 could be tinted, or constructed from a blue-colored material, such as an optical thermocast plastic color filter, available from Fosta-Tek Optics, or a Kodak Wratten filter (e.g., a Kodak 38A), and when used with a white LED, a blue illumination is produced at label 32. There are a wide variety of LED/filter combinations that can be used to create many illumination colors. Annular filter cover 62 may also be constructed to simultaneously diffuse lightwave 76. Additionally, as briefly discussed above, cylindrical adaptor 80 may be machined, or thermocasted, from a colored plastic material (available from Fosta-Tek Optics), and thus when used with a white LED, various illumination colors may be generated. Further, colored LED lens covers, e.g., a Chicago Miniature Lamp 434-6, can be used, which snap directly onto the LED itself, thus offering yet another method for achieving various illumination colors. Thus, there are a number of possibilities for creating various illumination colors.

Inner annular support structure 74 has a set of internal threads 64 for attachment to a set of external threads 66 in attached container receptacle 28.

Figure 4:
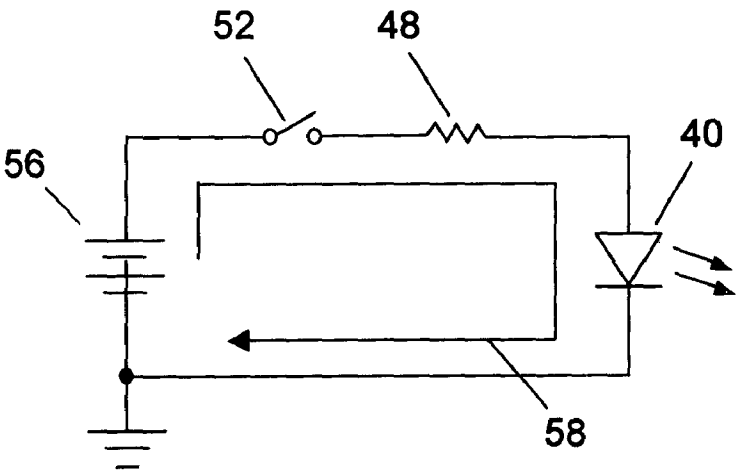
FIG. 4 is a circuit schematic of the preferred embodiment.

Printed circuit board 60 contains an energy source 56, e.g., a silver oxide button-cell, such as a Duracell D361, which may be attached directly to printed circuit board 60, or may be inserted in an energy source holder 57, e.g., a Keystone model 500, thus making it replaceable, an electrical current-limiting device 48, e.g., a Bourns Series 3309P potentiometer, the illumination source 40, and the electrical switch 52, all connected by PCB circuit traces in order to implement the closed circuit shown in FIG. 4. These circuit components can be inserted on printed circuit board 60 in an automated fashion (automatic insertion manufacturing typical to the electronics industry) or by manual methods. Alternatively, the closed circuit can be implemented by soldering the components together directly, without the use of the printed circuit board 60, and subsequently securing, and containing, the components in central opening 75 by an encapsulating potting compound, e.g., EPOCAP 14530A/2404B, available from Sanford Distributing Co., or a flexible adhesive, such as silicone rubber, e.g., Silastic® silicone rubber, available from Dow Corning.

In reading container label 32 and inspecting medicinal product 30 contained within container receptacle 28, in accordance with the present invention using container cap 22 illustrated in FIGS. 1 through 9, the individual initially retrieves medicine container 20 from the appropriate location (medicine cabinet, medicine drawer, bedside drawer, etc.). Once in hand, the individual holds medicine container 20 in such a way that at least one digit of his hand, preferably his forefinger, rests on flexible membrane 46. While reading container label 32, the individual presses flexible membrane 46 thus contacting cylindrical adaptor 80, which in turn contacts electrical switch 52. As switch 52 closes, an electrical current 58 flows from energy source 56 through electrical current-limiting device 48, and illumination source 40, and eventually back to energy source 56. As electrical current 58 flows through illumination source 40, illumination source 40 is energized and lightwave 76 is emitted. Electrical current-limiting device 48 can be adjusted to vary the intensity of lightwave 76. Since illumination source 40 is a wide-angle LED, light will emerge in a 360-degree, radial direction toward the lightwave entry end 67 and into light pipe channel 72. Lightwave 76 is directed by light pipe channel 72 through container cap 22 toward lightwave exit end 68. Lightwave 76 then travels through annular filter cover 62 to become light beams 36, which in turn illuminate container label 32. The individual may then read container label 32. On some medicine containers 20, there is also instructional text on the back of the container. For this case, the individual simply rotates medicine container 20 and performs the preferably identical procedure described above. Additionally, the individual may use container cap 22 to illuminate medicinal product 30. This can serve as an additional check that the individual is consuming the correct medicine. The individual would perform this function by removing container cap 22 from container receptacle 28, retrieving medicinal product 30, placing it in his palm, between his fingers, or on a tabletop, and then using container cap 22 as described above, while removed from container receptacle 28 or attached thereto, to illuminate medicinal product 30.

FIGS. 10 through 15 illustrate a second embodiment of a medicine container, generally 100, embodying a container cap, generally 102. Medicine container 100 also includes a container receptacle 28 and a container label 32, both preferably identical to those described in detail above.

Container cap 102 is comprised of an annular supporting structure 144 having a cavity 148 into which is fitted a printed circuit board 120. Thus, printed circuit board 120 is contained within container cap 102 and is preferably positioned perpendicular to the longitudinal axis of attached container receptacle 28. Printed circuit board 120 is secured in cavity 148 to annular supporting structure 144, preferably by adhesive 61, such as AS-124M removable adhesive, available from Adhesives Research, Inc., although other securing methods may be used. Annular supporting structure 144 also contains an annular receiving ledge 116 to accept container cap insert cover 24. Container cap insert cover 24 is connected to annular supporting structure 144 at annular receiving ledge 116 either by a frictional fit or by an adhesive, e.g., silicone rubber. Container cap insert cover 24 also contains flexible membrane 46, preferably identical to that described in detail above, which makes direct contact with electrical switch 52, e.g., a Panasonic EVQ-PLDA15. Container cap 102 also contains a plurality of annularly arranged openings 108 from which a plurality of lightwaves 104 emerge. The lightwaves 104 are generated by a plurality of illuminating sources 128, e.g., a blue light emitting diode, such as a Lumex SSL-LX3044USBC, although other LEDs, emitting other colors, or incandescent bulbs, such as a Copeland retinoscope lamp bulb, may be used. Annular supporting structure 144 is preferably fabricated by molding an opaque plastic material, such as colored Acrylic or colored Lexan. Additionally, annular supporting structure 144 can be machined from plastic stock (e.g., cast Acrylic rod).

Lightwaves 104 travel through a plurality of filter covers 110 to create a plurality of light source beams 106, which illuminate container label 32. Similar to the preferred embodiment discussed above, filter covers 110 may be manufactured with different colors depending on the color of the LED used. For example, filter covers 110 can be made from a blue-colored material to produce a bluish illumination if illuminating source 128 is a white LED. In fact, there are a wide variety of LED/filter combinations that can be used to create many light beams colors. Further, colored LED lens covers, e.g., a Chicago Miniature Lamp 434-6, can be used, which snap directly onto the LED itself, thus offering yet another method for achieving various illumination colors. Thus, there are a number of possibilities for creating various illumination colors. Filter covers 110 also provide environmental protection, e.g., waterproofing, for the internal components of container cap 102. Annular supporting structure 144 has a set of internal threads 64 for attachment to a set of external threads 66 in container receptacle 28.

Figure 15:
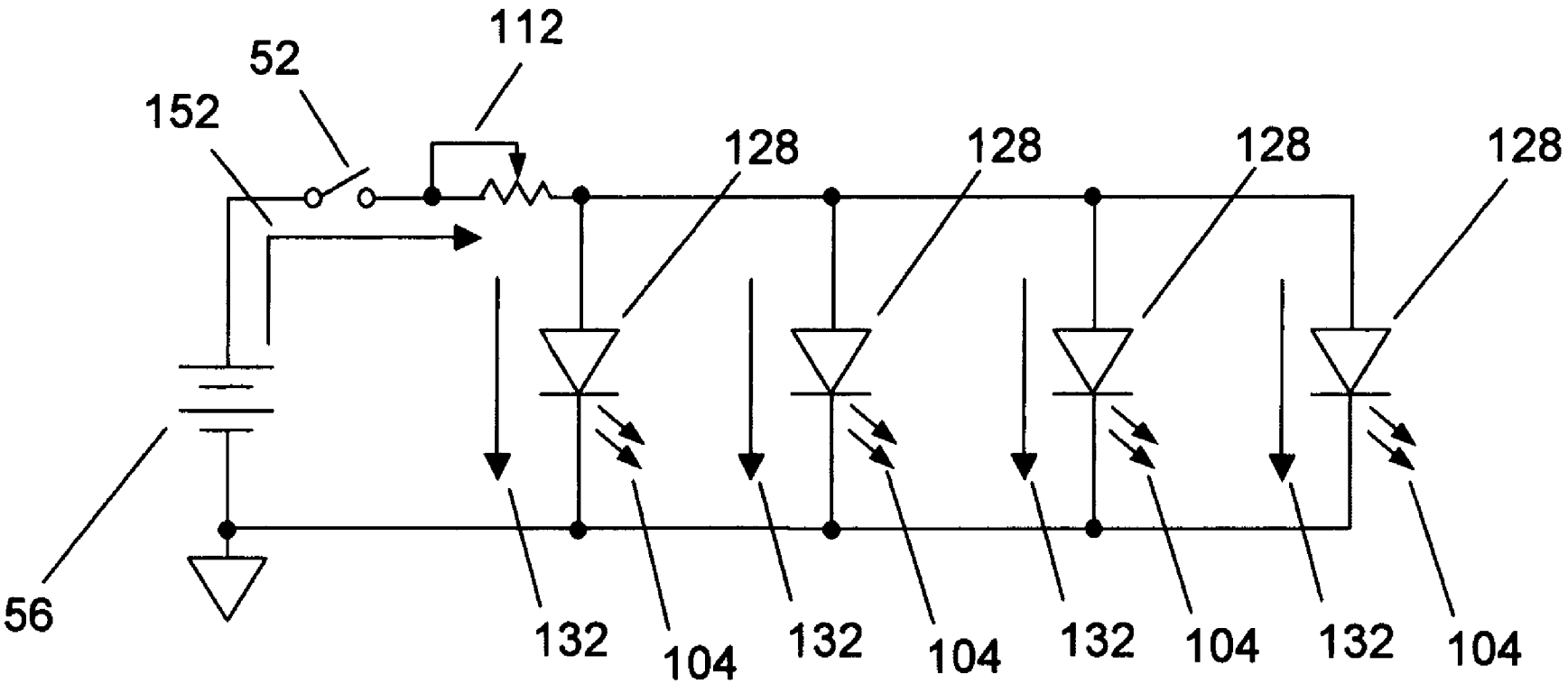
FIG. 15 is a circuit schematic of the second embodiment.

Printed circuit board 120 contains energy source 56, e.g., a Duracell D361, a variable current-limiting device 112, e.g., a Bourns Series 3309P, a plurality of illuminating sources 128, connected by a plurality of illuminating source leads 124, and electrical switch 52, all connected by PCB circuit traces in order to implement the closed circuit shown in FIG. 15. In the second embodiment four illuminating sources 128 are used, however, more or less illuminating sources 128 could be used to generate lightwaves 104. These circuit components can be inserted on printed circuit board 120 in an automated fashion (automatic insertion manufacturing typical to the electronics industry) or by manual methods.

Alternatively, the closed circuit can be implemented by soldering the components together directly, without the use of printed circuit board 120, and subsequently securing the components in cavity 148 by an encapsulating potting compound, e.g., EPOCAP 14530A/2404B,available from Sanford Distributing Co., or a flexible adhesive, such as silicone rubber, e.g., Silastic® silicone rubber, available from Dow Corning.

The second embodiment of the invention shown in FIGS. 10 through 15 utilizes the same functional principles as those described in the preferred embodiment above, but operates in a slightly different manner. The individual holds medicine container 100 in such a way that at least one digit of the individual's hand, preferably the forefinger, rests on flexible membrane 46. While reading container label 32, the individual presses flexible membrane 46 thus directly contacting electrical switch 52. As switch 52 closes, an electrical current 152 flows from energy source 56 through variable current-limiting device 112 and divides into a plurality of smaller electrical currents 132. Each of smaller electrical currents 132 flow through respective illuminating sources 128, and eventually combine to return back to energy source 56. As smaller electrical currents 132 flow through each illuminating source 128, each illuminating source 128 is energized and lightwaves 104 are emitted and travel through filter covers 110 to form light source beams 106. Variable current-limiting device 112 can be adjusted to vary the intensity of lightwaves 104. Light source beams 106 overlap in such a way that container label 32 is illuminated in its entirety. The individual may then read container label 32 in a variety of ways as described above in the preferred embodiment.

Figure 16:
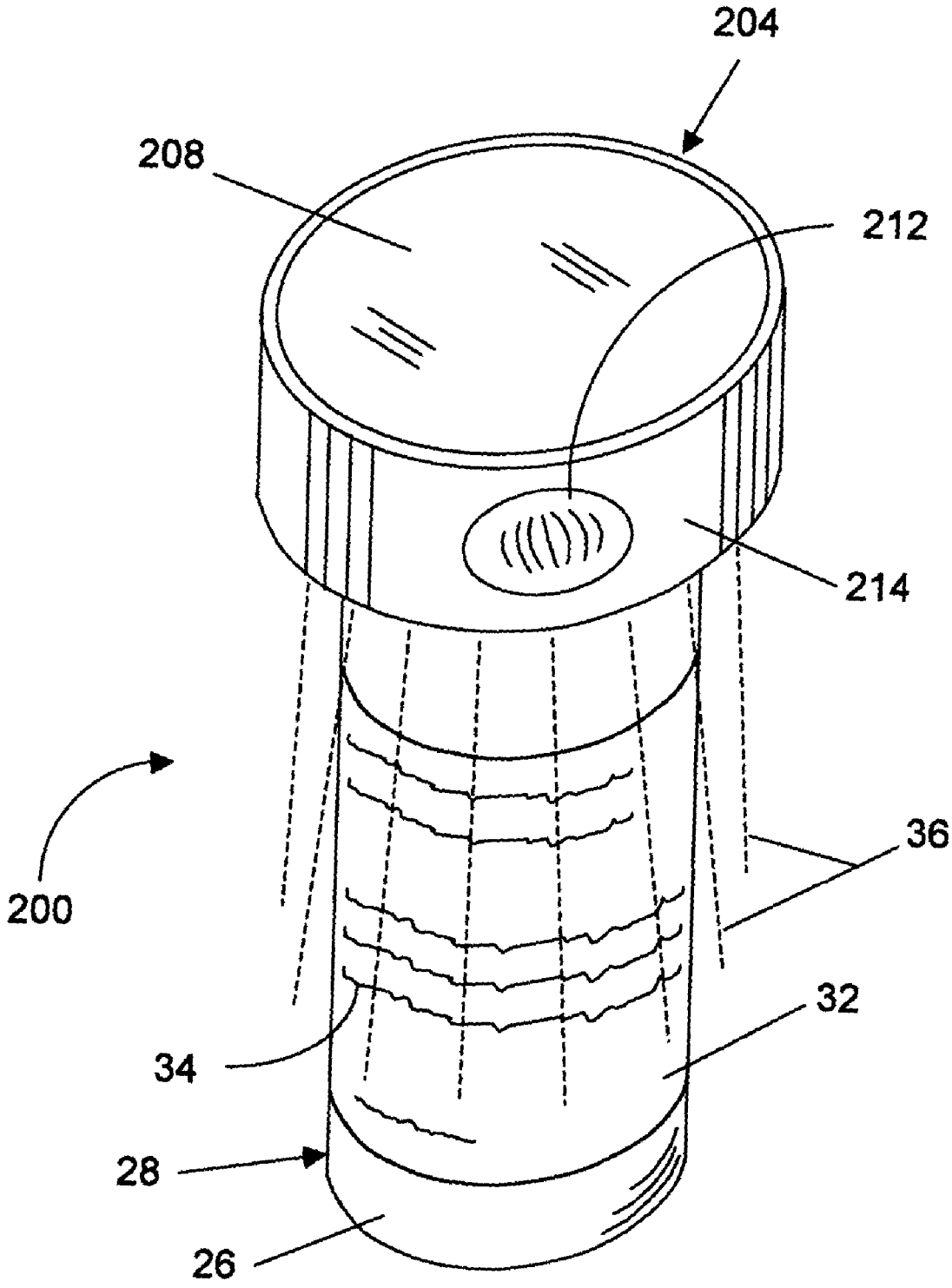
FIG. 16 is a perspective view of a third embodiment of a medicine container with a container cap describing a flexible membrane material covering a side-mounted switch.

FIG. 16 illustrates a third embodiment of a medicine container, generally 200, embodying a container cap, generally 204. Medicine container 200 also includes a container receptacle 28 and a container label 32, both preferably identical to those described in detail above. In this embodiment electrical switch 52 has been moved to the side of container cap 204 just beneath a side-mounted flexible membrane material 212 attached to a container cap side 214. A container cap insert cover 208 is connected to container cap 204 either by a frictional fit or by an adhesive, e.g., silicone rubber. Container cap 204 has internal structure, similar to that described in detail above, in order to enclose and support the appropriate printed circuit board and components.

The third embodiment of the invention shown in FIG. 16 utilizes the same functional principles as above, but operates in a slightly different manner. The individual holds medicine container 200 in such a way that at least one digit of his hand, preferably his thumb, rests on side-mounted flexible membrane 212. While reading container label 32, the individual presses flexible membrane 212 thus directly contacting electrical switch 52 just beneath. As electrical switch 52 closes, electrical current flows from energy source 56 and energizes the LEDs as described above (either the single LED of the preferred embodiment or the plurality of LEDs of the second embodiment). The individual may then read container label 32 or inspect medicinal product 30 in a variety of ways as described above in the preferred embodiment.

Figure 17:
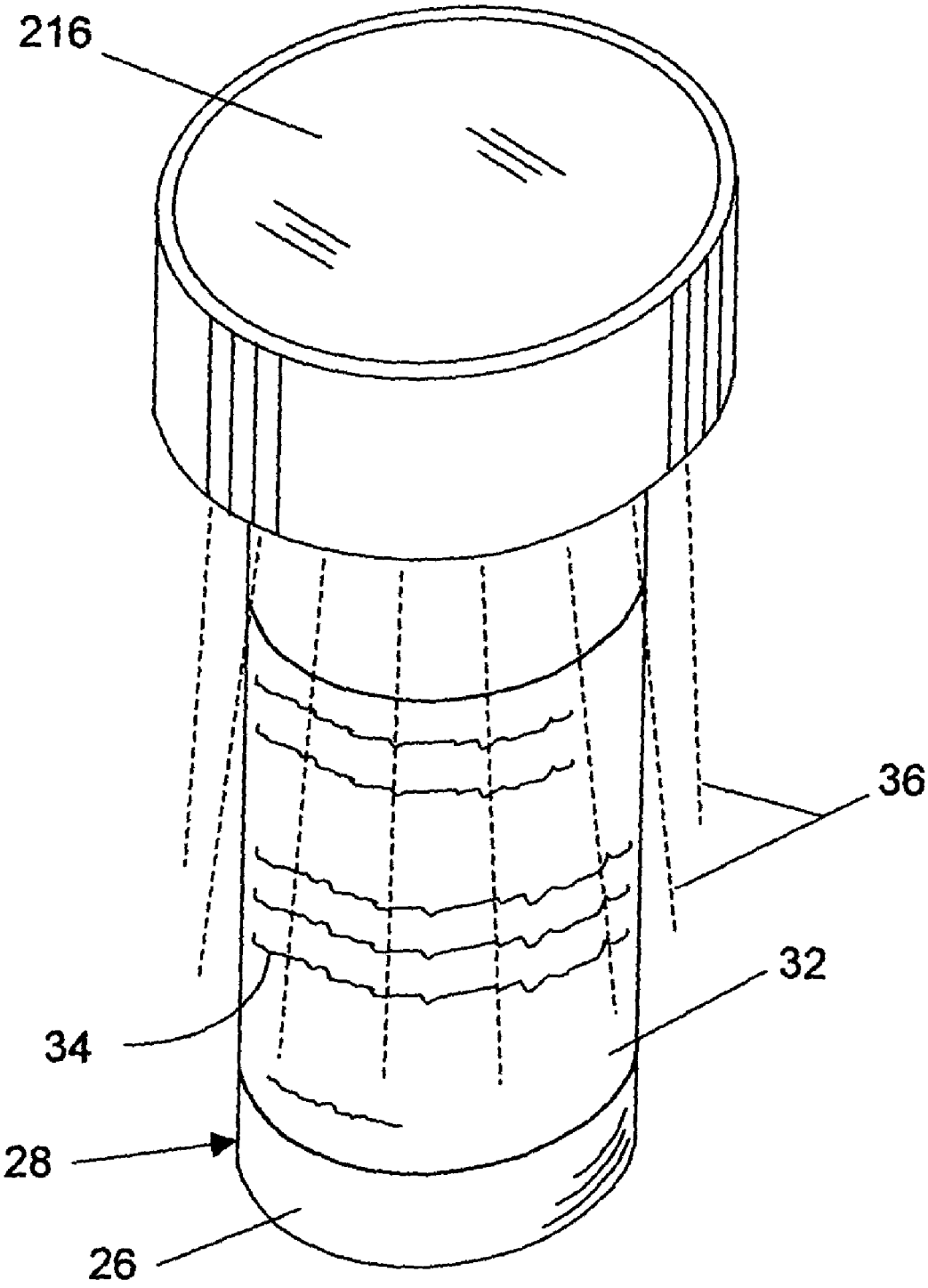
FIG. 17 is a perspective view of a fourth embodiment of a medicine container with a container cap describing a flexible container cap insert cover.

FIG. 17 illustrates a fourth embodiment of the invention, which provides a different method for activating the switch mechanism. In this embodiment a flexible container cap insert cover 216, preferably constructed entirely from a thin plastic or rubber material, is used to make contact with electrical switch 52 either directly, or indirectly through cylindrical adaptor 80. Flexible container cap insert cover 216 is connected to outer annular support rim 70 in the preferred embodiment, or to annular supporting structure 144 in the second embodiment, by a frictional fit (or by an adhesive, e.g., silicone rubber or AS-124M removable adhesive, available from Adhesives Research, Inc.).

In the fourth embodiment shown in FIG. 17 the individual holds medicine container 20 in such a way that at least one digit of his hand, preferably his forefinger, rests on flexible container cap insert cover 216. While reading container label 32, the individual presses flexible container cap insert cover 216 thus contacting cylindrical adaptor 80, which in turn contacts electrical switch 52 (FIG. 2), or by directly contacting the switch when cap insert cover 216 is used in the second embodiment shown in FIG. 11. The individual may then read container label 32 or inspect medicinal product 30 in a variety of ways as described above in the preferred embodiment.

Figure 18:
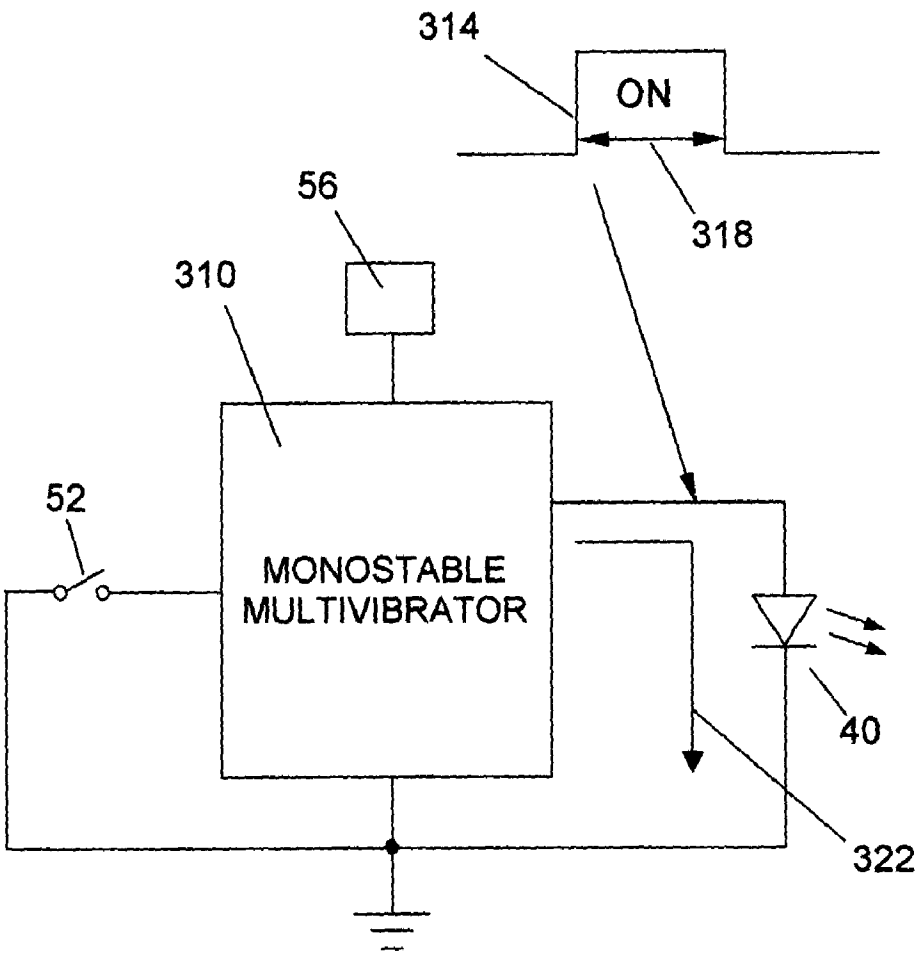
FIG. 18 is a block diagram of a fifth embodiment describing an additional circuit to control the LEDs used for illumination.

FIG. 18 illustrates a fifth embodiment of the invention whereby illumination source 40 is energized using a monostable multivibrator 310, e.g., a National Semiconductor LMC555CM, although other timer circuitry may be implemented. In this mode, a monostable pulse output 314, in the ON state, energizes illumination source 40. Illumination source 40 remains energized for a preset period of time, T, generally 318, thus ensuring that the LED is de-energized after a certain amount of time, further conserving energy source lifetime. Monostable multivibrator 310, illumination source 40, energy source 56, and electrical switch 52 can all be mounted on a printed circuit board similar to that described in the preferred embodiment above. Monostable multivibrator 310 can also energize illuminating sources 128 if used in the second embodiment described above.

The fifth embodiment shown in FIG. 18 operates to conserve the energy contained in energy source 56, thus prolonging its lifetime. The multivibrator circuit shown operates in a monostable, or "one-shot," mode. When switch 52 is pressed then released, monostable multivibrator 310 outputs a preset timed pulse just long enough for the individual to read container label 32, e.g., 15–20 seconds, although other times may be programmed. Monostable pulse output 314 energizes illumination source 40 for preset period of time, T 318. Energized illumination source 40 in turn illuminates container label 32 as described above. Once preset period of time, T 318 is complete, monostable pulse output 314 de-energizes illumination source 40 thus stopping a monostable pulse output electrical current flow 322 and conserving energy source 56. The individual may energize illumination source 40 again by pressing then releasing switch 52. This approach may also function with the second embodiment shown in FIGS. 10–15, whereby all four illuminating sources 128 would be energized by monostable pulse output 314.

Figure 19:
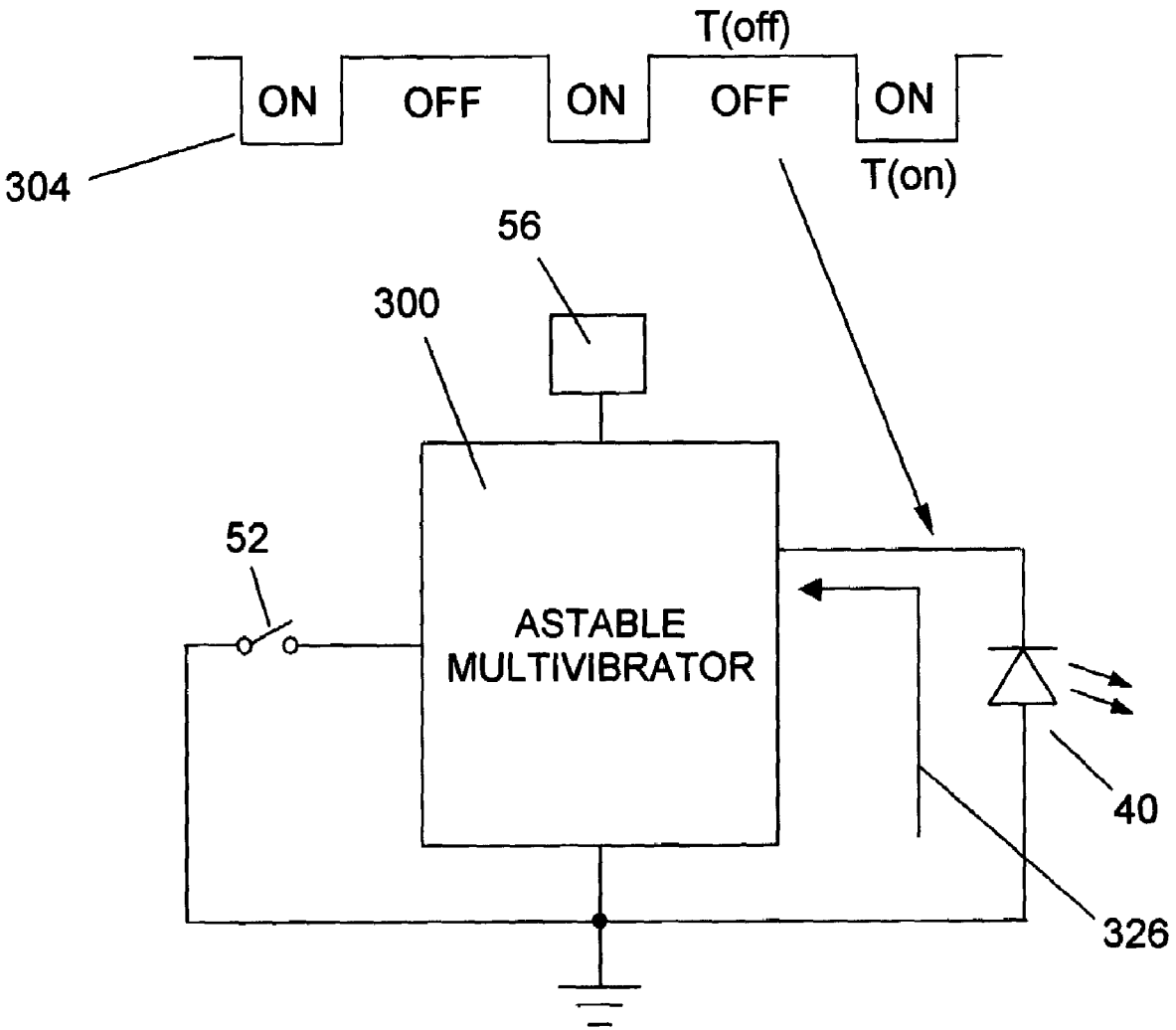
FIG. 19 is a block diagram of a sixth embodiment describing another circuit to control the LEDs used for illumination.

As described in FIG. 19, in a sixth embodiment, an astable multivibrator circuit 300, e.g., a National Semiconductor LMC555CM, although other timer circuitry may be implemented, can be used to energize illumination source 40 by turning it ON and OFF very rapidly. This has the dual effect of reducing the current illumination source 40 draws while energized, thus prolonging energy source 56 lifetime, while also changing the brightness of illumination source 40 by varying the voltage supplied to illumination source 40. Both of these features are accomplished by changing the duty cycle [T(on)/T(off)] of periodic pulse train, generally 304, output from astable multivibrator circuit 300. The maximum brightness, and maximum electrical current drain from energy source 56, occur when T(on)=T(off). Brightness and electrical current drain decrease as T(on) decreases and T(off) increases. Illumination will appear to be "ON" to the patient, e.g., not visibly flickering, as long as the frequency of the pulse train remains above approximately 60-Hz. Astable multivibrator circuit 300, illumination source 40, energy source 56, and electrical switch 52 can all be mounted on a printed circuit board similar to that described in the preferred embodiment above. Astable multivibrator circuit 300 can also energize illuminating sources 128 if used in the second embodiment described above.

The sixth embodiment shown in FIG. 19 operates to further conserve the energy contained in energy source 56, thus prolonging its lifetime. The multivibrator circuit shown operates in an astable mode, or "free-running" mode. When switch 52 is pressed and held closed, astable multivibrator circuit 300 outputs preset periodic pulse train 304. Periodic pulse train 304 presents a high state [T(off)] and a low state [T(on)] as shown in FIG. 19. In this embodiment, a low state energizes illumination source 40 while a high state de-energizes illumination source 40. In such a configuration, the average voltage delivered to illumination source 40 depends on the duty cycle, with no power dissipation during the OFF periods [T(off)] (e.g., no energy source electrical current drain). Astable multivibrator circuit 300 can be used to deliver a duty cycle from 50% to 99%. By using the LOW period [T(on)] of periodic pulse train 304 to power illumination source 40, and setting a 50% duty cycle [T(on)=T(off)] as the maximum brightness (and maximum energy source electrical current drain), one can control the illumination source 40 brightness and electrical current drain from virtually OFF (99% duty cycle) to a maximum ON (50% duty cycle). Periodic pulse train 304 of astable multivibrator circuit 300 energizes illumination source 40 with an astable output electrical current flow 326, which in turn illuminates container label 32 as described before. This approach may also function with the second embodiment shown in FIGS. 10–15, whereby periodic pulse train 304 would energize all four illuminating sources 128.

Figure 20:
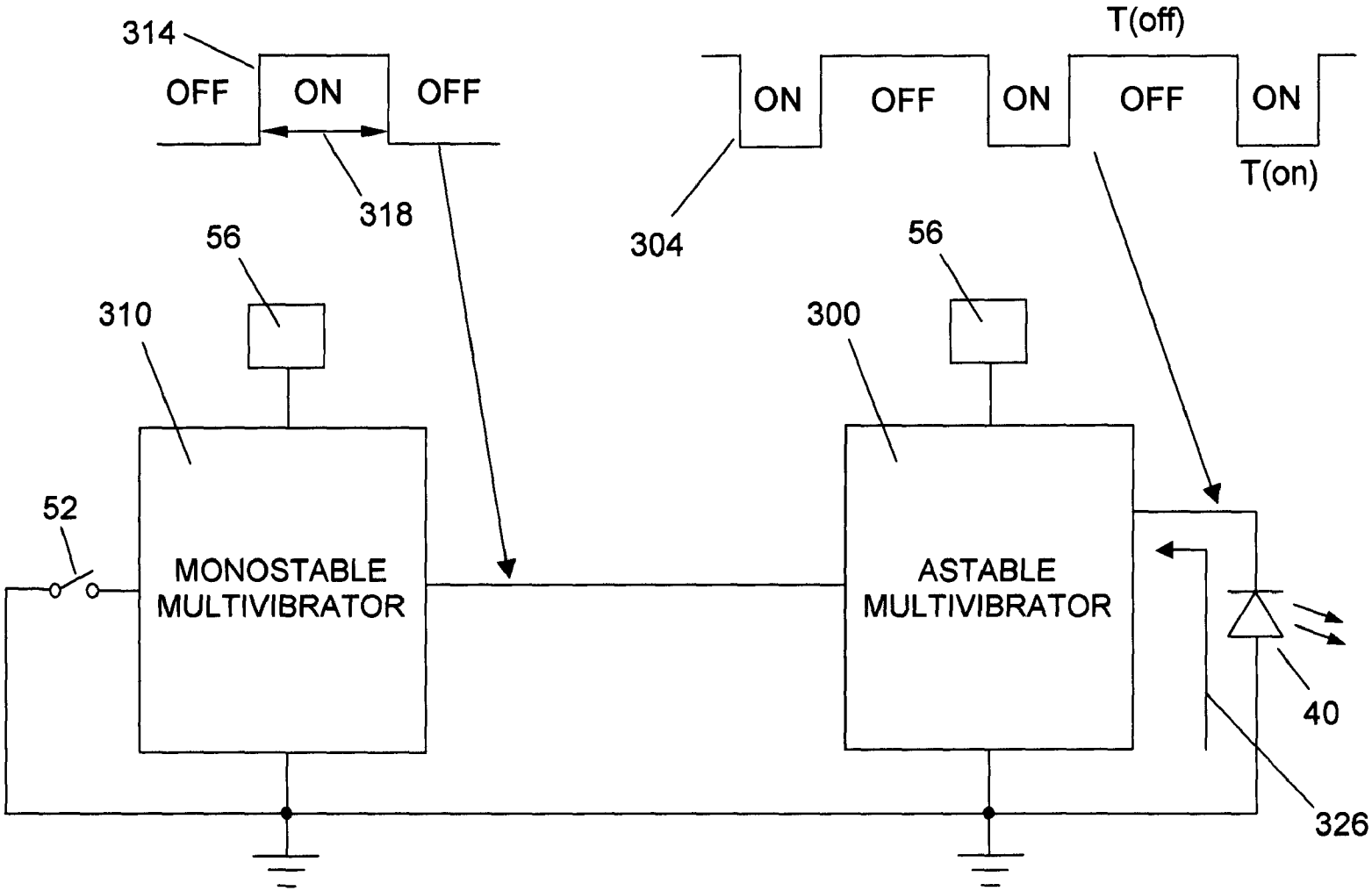
FIG. 20 is a block diagram of a seventh embodiment describing the combination of the circuitry shown in FIGS. 18 and 19 used to control the LEDs used for illumination.

FIG. 20 illustrates a seventh embodiment which combines monostable multivibrator 310 with astable multivibrator circuit 300. In this case a dual-timer integrated circuit, such as a National Semiconductor LM556CMXTR, may be used, although other timer circuitry may be implemented. Monostable multivibrator 310, astable multivibrator circuit 300, illumination source 40, energy source 56, and electrical switch 52 can all be mounted on a printed circuit board similar to that described in the preferred embodiment above. Monostable multivibrator 310 and astable multivibrator circuit 300 can also energize illuminating sources 128 if used in the second embodiment described above.

The seventh embodiment shown in FIG. 20 operates to further conserve the energy contained in energy source 56, thus prolonging its lifetime even further. When switch 52 is pressed then released, monostable multivibrator 310 outputs a preset timed pulse just long enough for the individual to read the container label 32, e.g., 15–20 seconds, although other times may be programmed. In this embodiment monostable pulse output 314 is used to activate astable multivibrator circuit 300, which in turn energizes illumination source 40 with periodic pulse train 304 as described above. Energized illumination source 40 in turn illuminates container label 32 as described before. Illumination source 40 is energized for preset period of time, T 318. Once preset period of time, T 318 is complete, monostable pulse output 314 de-activates astable multivibrator circuit 300 thus stopping astable output electrical current flow 326 and conserving energy source 56. The individual may energize illumination source 40 again by pressing then releasing switch 52. This approach may also function with the second embodiment shown in FIGS. 10–15, whereby periodic pulse train 304 would energize all four illuminating sources 128.

Figure 21:
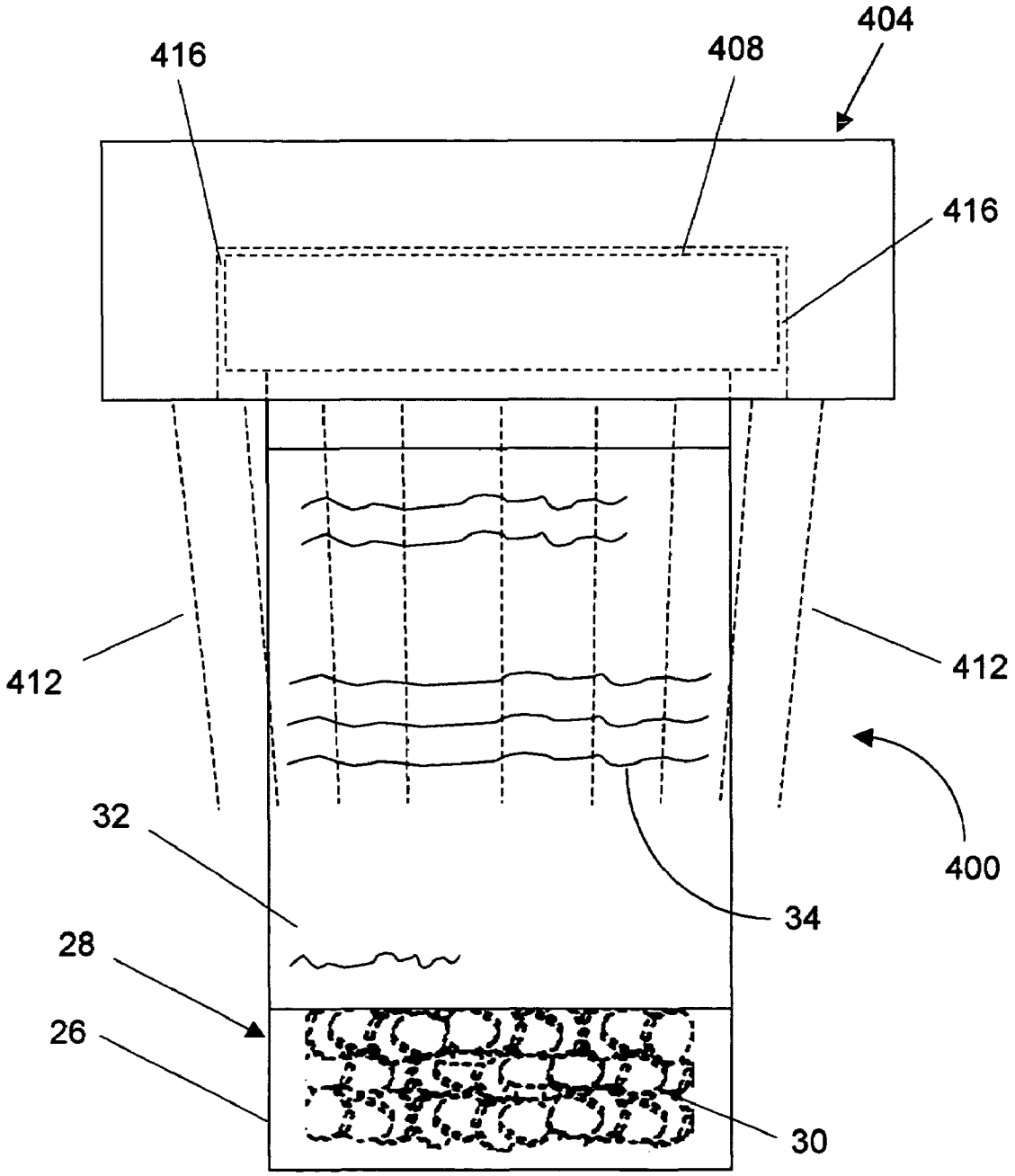
FIG. 21 is a side elevation view of an eighth embodiment of a medicine container with a container cap that is removably coupled to a conventional container cap and medicine container therewith.
Figure 22:
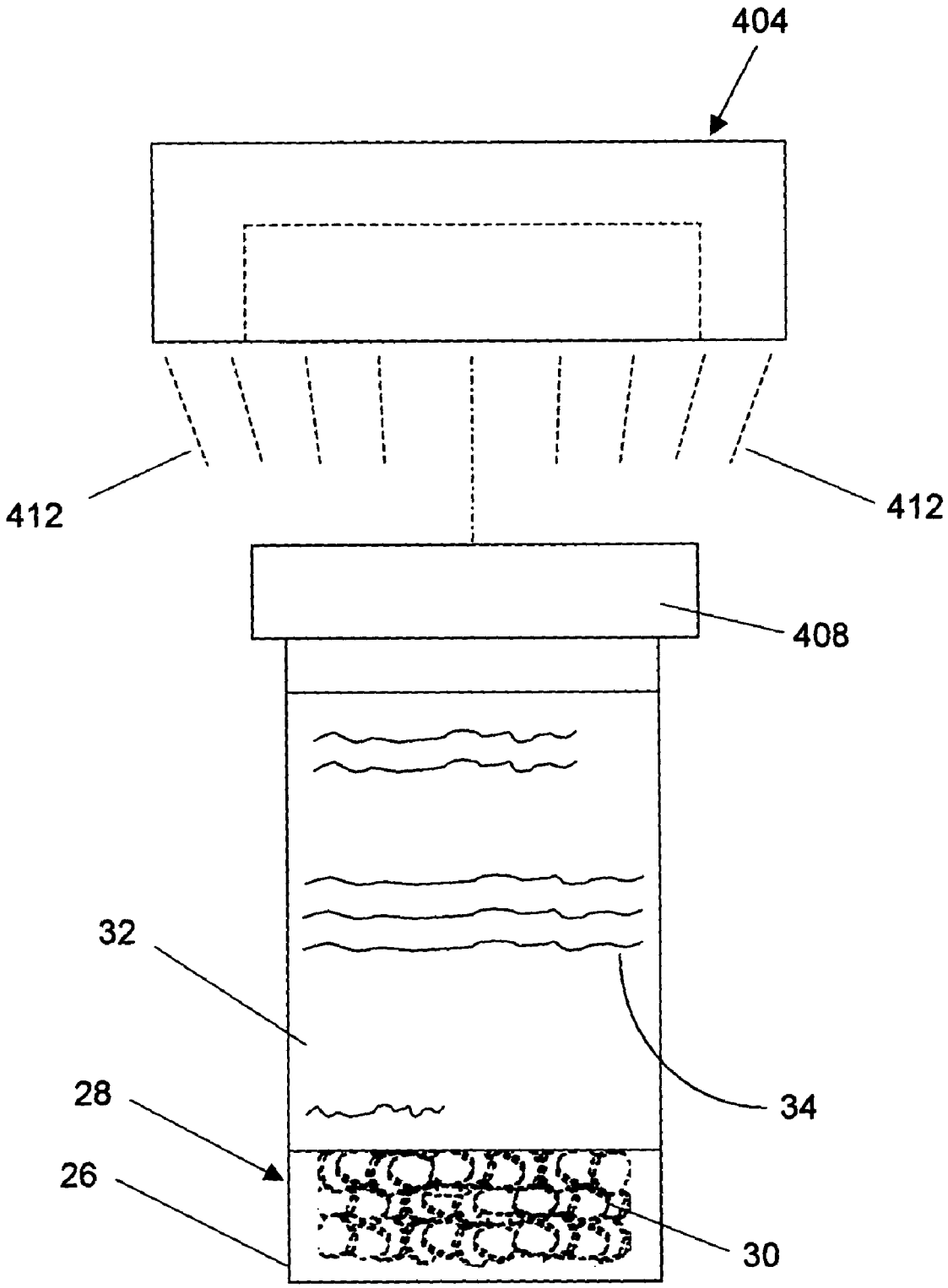
FIG. 22 is an exploded, side elevation view of the embodiment shown in FIG. 21 describing the physical relationship between the container cap and the conventional container cap, and medicine container therewith, in the decoupled state.

FIGS. 21 and 22 illustrate an eighth embodiment of the invention using a medicine container, generally 400, embodying a container cap, generally 404, a conventional container cap 408, and container label 32 attached to container receptacle 28, both preferably identical to those described in detail above. In this embodiment container cap 404 is removably coupled to conventional container cap 408. Container cap 404 is similar to container caps 22, 102, 204 described above with respect to illumination and control of illumination, but the structure used for attachment to container receptacle 28 is adapted to allow container caps 22, 102, 204 to attach directly to conventional container caps 408, which are currently supplied with medicine containers. That is, container cap 404 is removably connected to conventional container cap 408 at junction 416 by a frictional fit or by an adhesive, e.g., silicone rubber or AS-124M removable adhesive, available from Adhesives Research, Inc.

The eighth embodiment of the invention shown in FIGS. 21 and 22 utilizes the same principle as above, but operates in a slightly different manner. In reading container label 32 and inspecting medicinal product 30 contained within container receptacle 28, the individual retrieves medicine container 400 and then attaches container cap 404 directly to conventional container cap 408. The individual does so by initially aligning container cap 404 to conventional container cap 408, as shown in FIG. 22, and then pushing container cap 404 until it is firmly seated on conventional container cap 408, as shown in FIG. 21. The individual may then read container label 32 or inspect medicinal product 30 using light source beams, generally 412, in a variety of ways as preferably described in the above embodiments.

Figure 23:
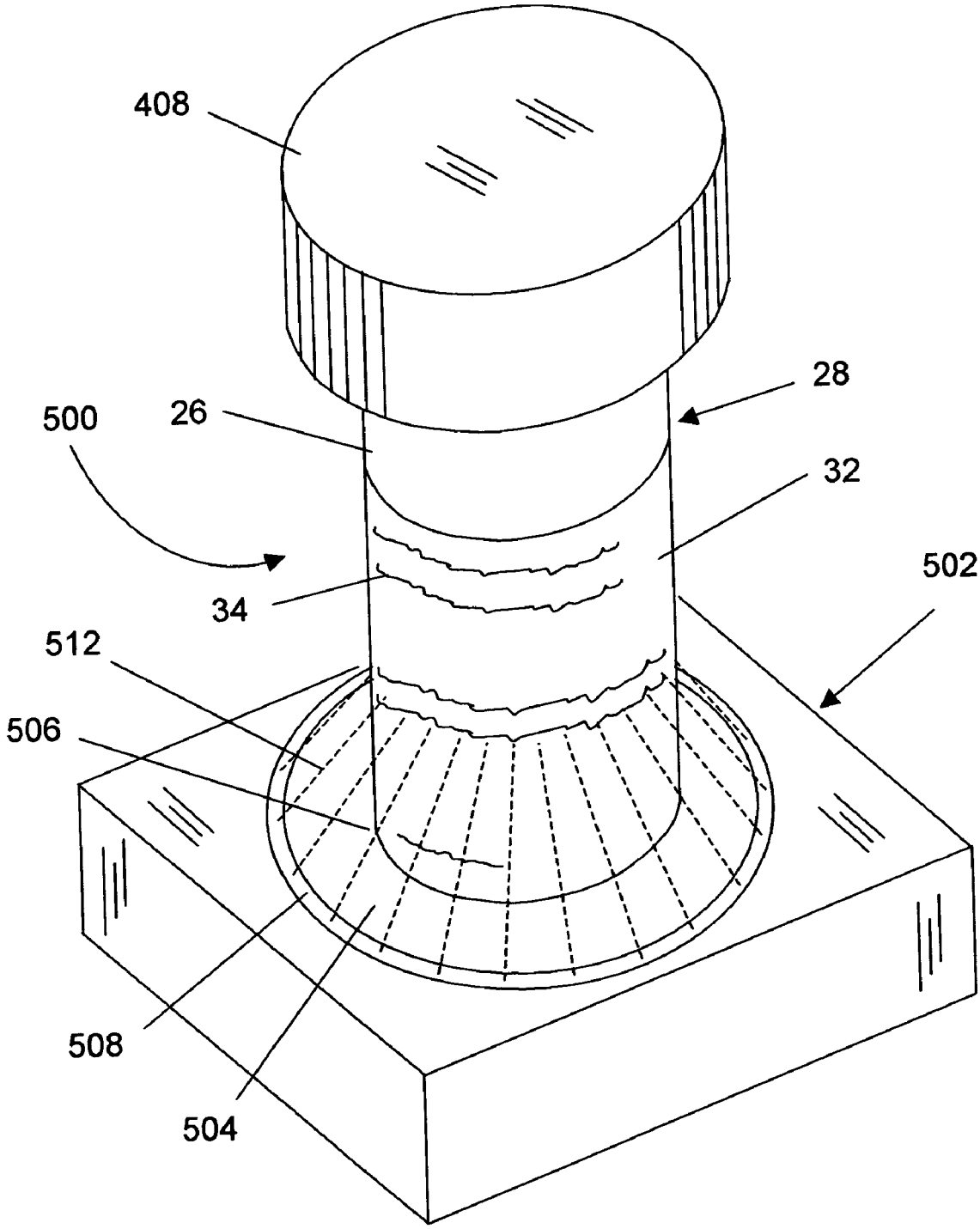
FIG. 23 is a perspective view of a ninth embodiment of a medicine container with a container illumination base that is removably coupled to the medicine container therewith.

FIGS. 23 and 24 illustrate a ninth embodiment of the invention using a medicine container, generally 500, embodying an illumination base, generally 502, and container label 32 attached to container receptacle 28, both preferably identical to those described in detail above. In this embodiment medicine container 500 is removably coupled to illumination base 502. Illumination base 502 is larger than medicine container 500 and serves as a supporting base to hold medicine container 500 when medicine container 500 is inserted into an opening 506, which contains a plurality of friction fingers 504 configured radially within illumination base 502. Friction fingers 504 are formed from a moldable flexible material, such as silicone rubber, and serve to press against medicine container 500 (see FIG. 24B) therefore holding it in place when medicine container 500 is placed in illumination base 502. Illumination of container label 32 occurs when a plurality of light source beams 512 are emitted from an annular output opening 508. Light source beams 512 are generated as described above using either a single LED 522 with a light pipe channel 518, preferably made from acrylic as described above, or with a plurality of LEDs (not shown) directed from illumination base 502 toward container label 32. Additionally, other light sources could be used to generate light source beams 512.

The ninth embodiment of the invention shown in FIGS. 23 and 24 utilizes the same principle as above, but operates in a slightly different manner. In reading container label 32 and inspecting medicinal product 30 contained within container receptacle 28, the individual retrieves medicine container 500 and then inserts it in opening 506 in illumination base 502 through friction fingers 504. As medicine container 500 contacts an electrical switch 516 within the base 502, just under friction fingers 504, LED 522 is energized and emits light source beams 512, which travel through light pipe channel 518 where they are directed to label 32. The individual may then read container label 32 or inspect medicinal product 30 using light source beams 512.

Figure 25:
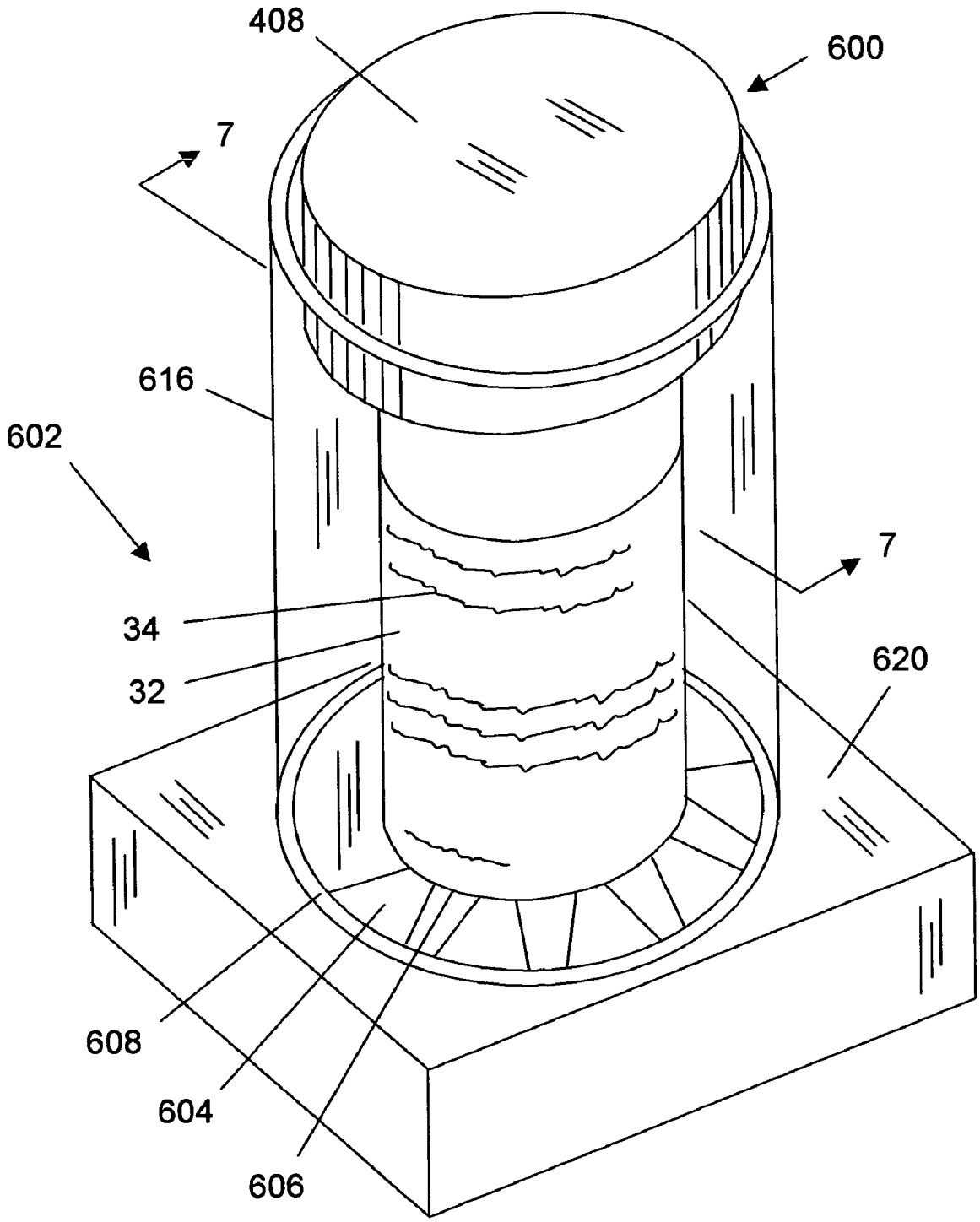
FIG. 25 is a perspective view of a tenth embodiment of a medicine container with an enclosing container illumination lightpipe that is removably coupled to the medicine container therewith.
Figure 26:
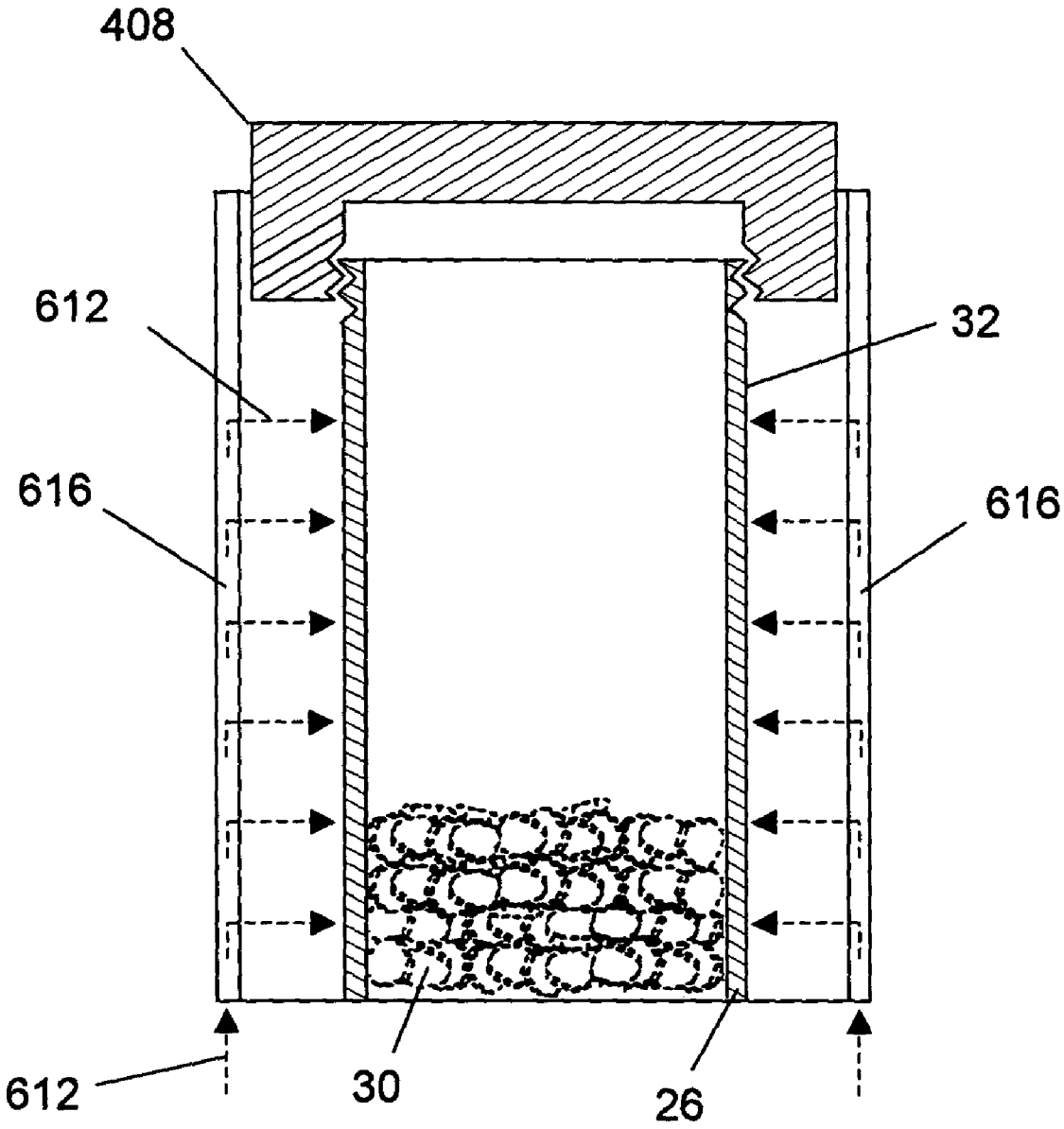
FIG. 26 is a cross-sectional profile through the medicine container and enclosing container illumination lightpipe, taken on line 7—7 in FIG. 25, describing a side view of the light source beam paths.

FIGS. 25 and 26 illustrate a tenth embodiment of the invention using a medicine container, generally 600, embodying an illumination base, generally 602, and container label 32 attached to container receptacle 28, both preferably identical to those described in detail above. In this embodiment medicine container 600 is removably coupled to illumination base 602. Illumination base 602 further consists of a supporting base 620 and an enclosing container illumination lightpipe 616, which is larger than medicine container 600 and aligns with an output aperture 608. Lightpipe 616 is preferably circular and made from acrylic, as described in the above embodiments. Lightpipe 616 could also be constructed in another shape, such as rectangular or square, as long as output opening 608 is of a similar configuration. Supporting base 620 serves as a supporting base to hold medicine container 600 when medicine container 600 is inserted into an opening 606, which contains a plurality of friction fingers 604. Friction fingers 604 are formed from a flexible material, such as silicone rubber, and serve to press against medicine container 600 therefore holding it in place when medicine container 600 is placed in supporting base 620. Illumination of container label 32 occurs when a plurality of light source beams 612 are emitted from an annular output opening 608 and travel through lightpipe 616 to label 32. Light source beams 612 are generated as described above using either a single LED with a light pipe channel (not shown), or with a plurality of LEDs (not shown) directed from supporting base 620 toward container label 32. Additionally, other light sources could be used to generate light source beams 612.

The tenth embodiment of the invention shown in FIGS. 25 and 26 utilizes the same principle as above, but operates in a slightly different manner. In reading container label 32 and inspecting medicinal product 30 contained within container receptacle 28, the individual retrieves medicine container 600 and then inserts it in enclosing container illumination lightpipe 616 until it engages friction fingers 604 within opening 606. As medicine container 600 contacts an electrical switch 516 (not shown) within the base 620, just under friction fingers 604, the LED is energized and emits light source beams 612, which travel through light pipe channel 616 where they are directed to label 32. The individual may then read container label 32 or inspect medicinal product 30 using light source beams 612.

There have been described and illustrated herein embodiments of a self-contained illumination cap for medicine containers and methods for using the same. While particular embodiments of the invention have been described, it is not intended that the invention be limited thereto, as it is intended that the invention be as broad in scope as the art will allow and that the specification be read likewise. Thus, it is recognized that although the container cap is shown connected to the medicine container receptacle by threads, thus signifying a typical, adult-type cap, with a screw-on, screw-off action, other types of connections will work as well. In particular, the container cap can be designed as a childproof or child resistant cap, e.g., those types that have to be further manipulated in some fashion before being removed; as an adult cap that simply snaps off or pulls off of the medicine container receptacle; or as a universal cap (e.g., such as one using o-rings to provide a frictional fit) that fits a wide variety of containers and/or conventional container caps. In other words, there are a number of attachment methods that may be implemented.

It is also recognized that although the light beams are created by an LED, other illumination sources may be used as well, such as incandescent bulbs, electroluminescent sources, or fluorescent sources, to name a few. Additionally, although the preferred embodiment shows only one LED centered in the container cap, more than one LED could be used to provide lightwaves to the light pipe channel. Also, although the second embodiment shows multiple LEDs used to illuminate the label (four LEDs shown) in a complete 360-degree range, the device can function with as few as one LED, that is, such illumination can be less dispersed. In this case, the container cap can be rotated through 360-degrees to read a label that completely encompasses the container.

It is further recognized that although the preferred embodiments describe a current-limiting device, such as a resistor or potentiometer, to limit electrical current delivered from the energy source to the illumination source, other illumination sources with built-in current limiting capabilities may be used, thus negating the use for a discrete current-limiting device (e.g., such as an LED with an internal resistor). Additionally, the energy source and illumination source may be chosen in such a way that there is no need for a current-limiting device (e.g., the battery voltage is just enough to supply the voltage required by the illumination source).

It is even further recognized that although the preferred embodiment describes a light guide constructed using the material inherent to the cap, other types of light delivery devices may be used as well, such as individual optical fibers or individual light pipes (e.g., acrylic plastic or liquid) designed to fit within the container cap. Additionally, although the light pipe channel of the preferred embodiment is shown with a flat entry surface, a curved entry surface can be constructed which acts to gather more light from the illumination source into the light pipe channel. Even further, a curved exit surface can be constructed which acts to focus more of the light to the label. Additionally, even though the annular filter cover is shown with a flat surface, a curved exit surface can be constructed which acts to focus more of the light to the label.

It is also understood that although the energy source is shown as a silver-oxide button cell, other battery-type energy sources may be used as well, such as mercury-oxide cells, lithium cells, lithium manganese dioxide, or zinc-air cells, to name a few. It is also conceivable that other sources of energy may be used to energize the LED. These include solar cells with some type of energy storage medium (such as a capacitor), fuel cells, or magneto-electric whereby energy is generated by motion and stored in some type of energy storage medium (e.g., a capacitor).

It is further understood that although the switch presented above to energize the illumination source is a manufactured, packaged switch, discrete switches made from individual parts (such as separate metal spring strips attached to the printed circuit boards) could be used as well. Additionally, although metal contact switches are presented, other switching mechanisms, such as liquid mercury tilt switches could be used. Further, although the switch is shown directly beneath the LED in the above embodiments, it could be placed in another location on the PCB. Even further, the switch mechanism could be placed within the outer walls of the cap, such that the patient could squeeze the cap anywhere along its sides to energize the illumination sources (e.g., a pair of metal strips can be designed within a flexible cap wall such that when the wall is squeezed, an outside circular metal strip would contact an inner circular metal switch thus connecting the energy source to the illumination source). That is, there are a number of possible construction methods and locations of devices that can be used to energize the illumination sources.

It is even further recognized that there are additional circuits, both discrete and integrated (ICs), that can perform equivalently to the monostable and astable multivibrator functions, that is, to conserve energy source lifetime and control LED brightness. Additionally, although surface mount components are described in the above embodiments, it is noted that more traditional, non-surface mount devices may be used as well.

It is even further understood, that although the current embodiments are shown with a flat flexible membrane, a raised or curved membrane could also be used. Additionally, although shown with a smooth surface, the top surface of the flexible membrane can also be manufactured with texture, such as raised lines or a raised cross-hatched pattern, providing further ease in using the device in low-light conditions.

It is additionally recognized that although the illumination base of the ninth and tenth embodiments is shown with a square shape, other shapes, such as circular, oval, rectangular, hexagonal, etc. could be utilized as well. Even further, although the opening that accepts the medicine container is shown as being circular, it could also be of a variety of shapes, such as oval, square, rectangular, hexagonal, etc. That is, there are a number of variations for the base construction with respect to its shape and opening. Additionally, although radial friction fingers, which hold the medicine container in the base, are shown, other configurations of friction fingers could be used, such as a plurality of fingers arranged in a parallel fashion to each other. It is also recognized that although only one opening is shown in the illumination base, there could be a plurality of openings with accompanying illumination means for each, such that a number of containers could be viewed simultaneously. Further, although an internal electrical switch is shown and used to energize the illumination sources, it is recognized that an external switch, mounted on the top surface or side surface of the illumination base, may also be used to energize the illumination sources. Even further, although an electrical switch is shown, it is recognized that an electro-optical switch mechanism could be implemented such that when the container is inserted in one of the illumination base openings, the container body interacts with the electro-optical switch such that the illumination sources are energized.

It will also be appreciated by those skilled in the art that yet other modifications could be made to the provided invention without deviating from its spirit and scope as claimed. As such, those skilled in the art will appreciate that the conception, upon which this disclosure is based, may readily be utilized as a basis for the designing of other structures, methods and systems carrying out the several purposes of the present invention. It is important, therefore, that the claims be regarded as including such equivalent construction insofar as they do not depart from the spirit and scope of the present invention.

What is claimed is:

1. An illuminating apparatus, comprising:

a) a container having a wall with a container outer surface provided with a label;

b) a container cap removably couplable to said container;

c) at least one illumination source at least partially enclosed by said container cap;

wherein said container cap is adapted to direct at least one light beam produced by said at least one illumination source to the label surface exposed external to the container.

2. The illuminating apparatus according to claim 1, wherein:

said container cap includes means for removable attachment to said container.

3. The illuminating apparatus according to claim 1, wherein:

said container cap includes means for removable attachment to a supplied conventional container cap, said supplied conventional container cap removably attaches to said container.

4. The illuminating apparatus according to claim 1, wherein:

said container cap includes a container cap insert cover.

5. The illuminating apparatus according to claim 4, wherein:

said container cap insert cover is attached to said container cap, and movement of said container cap insert cover operates to energize said at least one illumination source.

6. The illuminating apparatus according to claim 5, wherein:

a downward movement of said container cap insert cover energizes said at least one illumination source.

7. The illuminating apparatus according to claim 6, wherein:

said downward movement energizes said at least one illumination source for a preset period of time.

8. The illuminating apparatus according to claim 1, wherein:

said container cap includes a container cap side, and a side-mounted flexible membrane material is attached to said container cap side.

9. The illuminating apparatus according to claim 8, wherein:

said side-mounted flexible membrane material is adapted to be moved inwardly to energize said at least one illumination source.

10. The illuminating apparatus according to claim 1, wherein:

said container cap includes an electrical switch to energize said at least one illumination source.

11. The illuminating apparatus according to claim 1, wherein:

said at least one illumination source is at least one light emitting diode.

12. The illuminating apparatus according to claim 1, wherein:

said container cap includes at least one energy source for producing an electrical current.

13. The illuminating apparatus according to claim 12, wherein:

said container cap includes a means for reducing said electrical current used by said at least one illumination source.

14. The illuminating apparatus according to claim 13, wherein:

said means for reducing varies the brightness of said at least one illumination source.

15. The illuminating apparatus according to claim 13, wherein:

said means for reducing is a potentiometer, resistor, or astable multivibrator circuit.

16. The illuminating apparatus according to claim 1, wherein:

said container cap includes one or more surfaces to direct said at least one light beam from said at least one illumination source to said label.

17. The illuminating apparatus according to claim 16, wherein:

said surfaces are provided with one or more optical coatings, and at least one of said optical coatings is a reflective coating.

18. The illuminating apparatus according to claim 1, wherein:

said container cap includes a printed circuit board, said printed circuit board contains said at least one illumination source mounted to emit said at least one light beam toward said label.

19. The illuminating apparatus according to claim 1, wherein:

said container cap includes at least one filter cover.

20. The illuminating apparatus according to claim 19, wherein:

said at least one filter cover changes the color of said at least one light beam.

21. The illuminating apparatus according to claim 19, wherein:

said at least one filter cover diffuses said at least one light beam.

22. The illuminating apparatus according to claim 19, wherein:

said at least one filter cover focuses said at least one light beam onto said label.

23. An illuminating apparatus for illuminating a container label, comprising:

a) a container having a wall with a container outer surface;

b) housing means couplable to said container, said housing means having at least one output opening;

c) illumination means within said housing means for directing at least one light beam for illuminating the label surface exposed external to the container;

d) controlling means within said housing means for controlling said illumination means.

24. The illuminating apparatus according to claim 23, wherein:

said housing means includes a means for removably attaching said housing means directly to one of (i) said container, and (ii) a supplied conventional container cap, said supplied conventional container cap is removably attached to said container.

25. The illuminating apparatus according to claim 23, wherein:

said means for controlling said illumination means includes, (i) an electrical energy means for energizing said illumination means;

(ii) an electrical current limiting means for limiting an electrical current to said illumination means, said electrical current produced by said electrical energy means; and (iii) an electrical switching means for electrically connecting said electrical energy means to said illumination means.

26. The illuminating apparatus according to claim 23, wherein:

said illumination means is provided by at least one of:

(i) a light emitting diode;

(ii) an incandescent light source;

(iii) a fluorescent light source; and (iv) an electroluminescent source.

27. A method of illuminating a label on a container, comprising the steps of:

a) coupling an illumination source to a cap enclosing the container; and b) illuminating the label surface exposed external to of the container with said illumination source.

28. A method according to claim 27, wherein:

said coupling and said illuminating includes providing illumination for a medicine container.

29. An illuminating apparatus for illuminating a container label, comprising:

a) a container having a wall with a container outer surface;

b) a container cap including a container cap side, said container cap removably couples to said container and includes means for illuminating said container outer surface; and c) said side-mounted flexible membrane material is adapted to be moved inwardly to energize said means for illuminating; and d) a light guide means within said container cap for directing at least one ligth beam produced by said means for illuminating, to the label surface exposed external to the container.

30. An illuminating apparatus mountable on a removable closure of a container, the container having an outer surface with a label, the apparatus comprising:

a cap having structure which couples over at least a portion of the closure by friction-fit or threaded connection, the cap including means for front lighting the label on the outer surface of the container when the cap is coupled to the removable closure.

31. An illuminating apparatus, comprising:

a) a container having a wall with a container outer surface provided with a label;

b) housing means closing said container, said housing means having at least one output opernng;

c) illumination means within said housing means for creating at least one light beam for illuminating said container outer surface;

d) controlling means within said housing means for controlling said illumination means;

e) light guide means within said housing means for directing said at least one light beam from said illumination means to said label.

f) said light guide means includes one or more surfaces to direct said at least one light beam from said illumination means to said label; and g) said at least one surface of said surfaces is a cap outer surface, said cap outer surface is constructed to focus said at least one light beam to said label.

* * * * *